US009591877B2

(12) United States Patent
Mazourik et al.

(10) Patent No.: US 9,591,877 B2
(45) **Date of Patent: *Mar. 14, 2017**

(54) FUNCTIONAL BRASSIERE

(71) Applicant: Sergei Mazourik, Delémont (CH)

(72) Inventors: Sergei Mazourik, Delémont (CH); Oksana Mazourik, Delémont (CH); Katharina Mazourik, Delémont (CH); Michael Mazourik, Delémont (CH)

(73) Assignee: Sergei Mazourik, Delémont (CH)

( * ) Notice: Subject to any disclaimer, the term of this patent is extended or adjusted under 35 U.S.C. 154(b) by 25 days.

This patent is subject to a terminal disclaimer.

(21) Appl. No.: 14/871,393

(22) Filed: Sep. 30, 2015

(65) Prior Publication Data

US 2016/0015090 A1 Jan. 21, 2016

Related U.S. Application Data

(63) Continuation-in-part of application No. 13/977,245, filed as application No. PCT/CN2012/086384 on Dec. 11, 2012, now Pat. No. 9,265,288.

(51) Int. Cl.
*A41C 3/00* (2006.01)

(52) U.S. Cl.
CPC ..... *A41C 3/0028* (2013.01); *A41C 3/0071* (2013.01)

(58) Field of Classification Search
CPC .. A41C 3/00; A41C 1/00; A41C 3/148; A41C 3/10; A41C 3/0064; A41C 3/0071; A41C 3/02
USPC .. 450/14–17, 23, 25, 30, 31, 27, 28, 58, 79, 450/64, 85, 91; 2/104, 106, 96, 102, 109, 2/110, 114
See application file for complete search history.

(56) References Cited

U.S. PATENT DOCUMENTS

| | | | | |
|---|---|---|---|---|
| 1,288,927 A * | 12/1918 | Kops | A41C 3/00 450/79 |
| 1,417,930 A * | 5/1922 | Mailleue | A41C 3/10 450/57 |
| 1,575,989 A | 3/1926 | Haven | |
| 2,344,374 A | 3/1944 | Stephens | |
| 2,753,563 A | 7/1956 | Blitch | |

(Continued)

FOREIGN PATENT DOCUMENTS

| | | |
|---|---|---|
| CN | 101141893 A | 3/2008 |
| CN | 101627840 A | 1/2010 |

(Continued)

OTHER PUBLICATIONS

Viazourik, Sergei, et al., PCT/CN2011/080513 International Search Report (ISR) p. 3, reference 'JP9-11903A (Renaun KK.) May 6, 1997'.

*Primary Examiner* — Gloria Hale
(74) *Attorney, Agent, or Firm* — Bryant J. Keller; Kirton McConkie, PC

(57) ABSTRACT

A functional garment includes a single breast supporting device that includes a breast cup, a connector, and a support strap. The breast cup supports a single breast of a user. The breast cup connector comprises an elastomeric material extending along a lateral side of the breast cup. The support strap connects to the connector and connects to the breast cup. The functional garment simultaneously provides orthopedic support to the user and visual enhancement of the breasts. Other implementations are disclosed.

20 Claims, 26 Drawing Sheets

(56) References Cited

U.S. PATENT DOCUMENTS

| | | | | | |
|---|---|---|---|---|---|
| 2,993,490 | A | | 7/1961 | Serra | |
| 3,040,750 | A | * | 6/1962 | Hurwitz | A41C 3/02 450/58 |
| 3,094,125 | A | * | 6/1963 | Lewis | A41C 3/148 450/59 |
| 3,339,554 | A | | 9/1967 | Nobbs | |
| 3,756,247 | A | | 9/1973 | Hand | |
| 3,826,266 | A | * | 7/1974 | Alpert | A41C 3/0071 2/73 |
| 4,185,332 | A | * | 1/1980 | Jahnig | A61F 2/52 450/54 |
| 4,269,191 | A | * | 5/1981 | Evans | A41C 3/148 450/64 |
| 4,391,277 | A | | 7/1983 | Horvat | |
| 4,475,552 | A | | 10/1984 | Yoshihara | |
| 4,642,818 | A | | 2/1987 | Dehnert et al. | |
| 4,698,847 | A | | 10/1987 | Yoshihara | |
| 5,974,592 | A | | 11/1999 | Tabrizi | |
| 6,089,954 | A | | 7/2000 | Grewe | |
| 6,220,924 | B1 | * | 4/2001 | Kobayashi | A41C 3/0092 450/1 |
| 6,402,586 | B1 | * | 6/2002 | Winik | A41C 3/0064 450/1 |
| 6,430,753 | B2 | | 8/2002 | Duran | |
| 6,431,947 | B1 | | 8/2002 | Henz | |
| 6,604,983 | B1 | * | 8/2003 | Denn | A41C 3/148 450/1 |
| 7,056,186 | B1 | | 6/2006 | Weyenberg et al. | |
| 2007/0149093 | A1 | | 6/2007 | Lutz | |
| 2008/0194181 | A1 | | 8/2008 | Sudo et al. | |
| 2009/0025124 | A1 | | 1/2009 | Gearhart | |
| 2009/0139003 | A1 | | 6/2009 | Lee | |
| 2011/0117819 | A1 | | 5/2011 | Redenius | |
| 2014/0057530 | A1 | | 2/2014 | Mazourik et al. | |

FOREIGN PATENT DOCUMENTS

| | | | |
|---|---|---|---|
| CN | 201758775 | U | 3/2011 |
| CN | 202525102 | U | 11/2012 |
| EP | 1 005 799 | A1 | 6/2000 |
| FR | 604 263 | A | 5/1926 |
| FR | 720593 | A | 2/1932 |

* cited by examiner

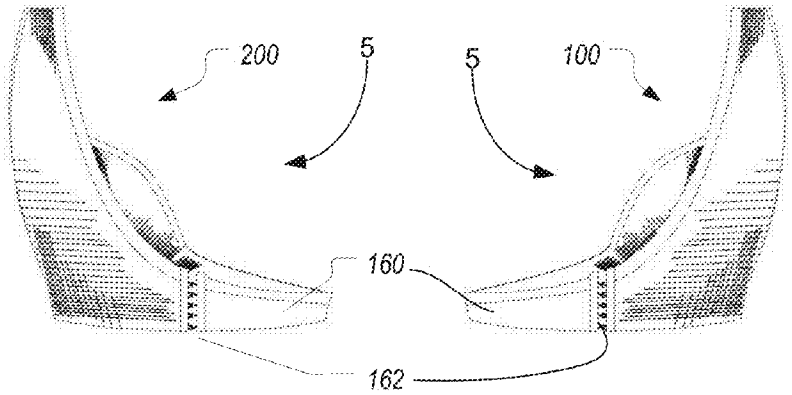
FIG. 14A
FIG. 14B
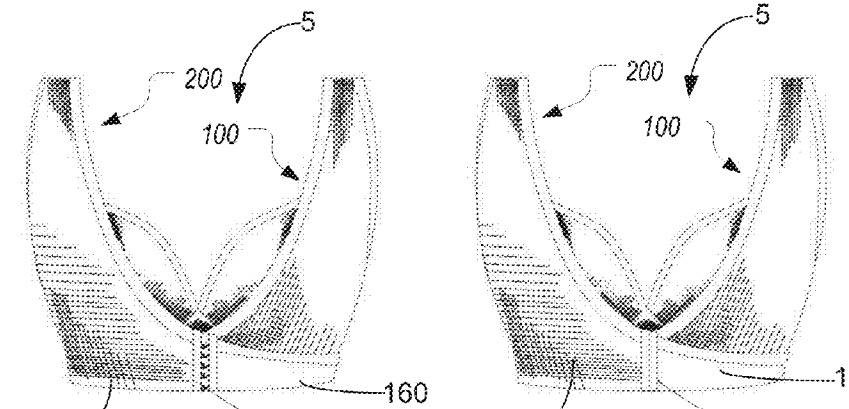
FIG. 14C
FIG. 14D

FUNCTIONAL BRASSIERE

RELATED APPLICATIONS

This application is a continuation-in-part application of U.S. patent application Ser. No. 13/977,245, entitled "FUNCTIONAL BRASSIERE", filed on Jun. 28, 2013, which is a nationalization of PCT Application Serial No. PCT/CN2012/086384, entitled "FUNCTIONAL BRASSIERE", filed Dec. 11, 2012. The disclosures of the applications to which the present application claims priority are incorporated by reference in their entirety.

BACKGROUND OF THE INVENTION

1. Field of the Invention

This invention relates to a brassiere (a functional garment). More specifically, some implementations relate to a functional brassiere that simultaneously provides orthopedic benefits as well as visual breast enhancement.

2. Background and Related Art

Throughout history, attempts have been made to design garments that improve a physical and/or a visual appearance of a wearer. An improved physical appearance can lead to an increase in self-esteem and confidence of the wearer and can produce additional physiological and physical benefits. Because of these benefits, many people continue to develop and produce garments that increase the wearer's physical appearance and that are configured to provide support to a portion to a wearer's body. Among such garments is a bra (or brassiere), an undergarment designed to support a woman's breasts and/or to improve a physical and/or visual appearance of the wearer.

A plethora of different bra models have been designed to provide support to a wearer's breasts, to enhance the size and/or shape of the wearer's breasts, to elevate the wearer's breasts, to increase comfort, and/or to be fashionable. For example, a push-up bra is designed to elevate and draw the breasts together to create cleavage, to give the appearance of increased breast size, and to improve the appearance of the wearer's body outline.

While push-up bra designs can increase physical appearance, some such bras can also cause discomfort and physiological strain. These bras are typically designed with a pair of breast cups statically attached to a back strap that encircles the wearer's torso. In some cases, shoulder straps are statically attached to the top of each breast cup and extend over the wearer's shoulder and then statically attach to the back strap. Because the shoulder straps (in some conventional push-up bras) provide the primary or only mechanism for achieving an upward force to elevate the breasts, the shoulder straps often also exert a countervailing downward force on the shoulder, back, and/or neck. This countervailing downward force can increase static and dynamic pressure and/or load on these areas, leading to discomfort, pain, poor posture, and stooping of the back. It can also cause the thoracic section of the spine to protrude backwards, bending of the head forward, flattening of the chest, slouching of the shoulders forward, rounding of the back, protrusion of the stomach forward, and/or protrusion of the shoulder blades from the back. Incorrect posture and stoop can also lead to strain to the skeletal structure; motor apparatus disorder; headaches; malfunctions of the respiratory, nerve, and/or cardiovascular systems; droopy abdomen; spine aches; weakening of the sural and hip muscles; reduced waist mobility; flaccid facial skin; appearance of a double chin; and/or other physiological maladies.

Some orthopedic bras have been developed to improve posture and counteract stoop caused by wearing a bra. Oftentimes, these orthopedic bras are designed to pull the shoulders back and to draw the shoulder blades together, thereby decreasing the pressure on the shoulders, back, and neck while improving posture and combating stoop. Although some orthopedic bras may provide these physical benefits, some may also reduce the aesthetic appearance of the breasts and the bodyline. For example, by bringing the shoulders back, some orthopedic bras greatly reduce the appearance of cleavage and cause the breasts to point outwardly rather than forward.

Thus, while a variety of bra designs currently exist, challenges still exist, including those listed above. Accordingly, it would be an improvement in the art to augment or even replace current techniques with other techniques.

SUMMARY OF THE INVENTION

The present application relates to functional garments and more specifically to functional brassieres. In some implementations, a functional brassiere comprises a first single breast supporting device. In some implementations, the first single breast supporting device comprises a first breast cup, a first breast cup connector, and a first support strap. The first breast cup can be configured to support a first single breast of a user. The first breast cup can also comprise an inner edge configured to be disposed near a medial portion of the user's chest when the user wears the functional garment. The first breast cup connector can comprise any suitable material, including, without limitation, a first piece of elastomeric material extending along a lateral side of the first breast cup. The first support strap can comprise a first shoulder loop, a first connecting panel, and/or a first cross strap. Indeed, in some implementations, the first support strap comprises a first shoulder loop and/or a first cross strap. A first portion of the first shoulder loop can be connected (and/or the first support strap), at least in part, to an upper lateral portion of the first breast cup connector and/or can be configured to extend over a first shoulder of the user. A second portion of the first shoulder loop can be connected (and/or support strap), at least in part, to a lower lateral portion of the first breast cup connector and can be configured to extend, at least in part, around a portion of the user's torso. The first portion and the second portion can be configured to join together to form a first connecting panel with the first connecting panel extending into a first cross strap that can be configured to extend around a portion of user's torso and attach to the inner edge of the first breast cup.

These and other features and advantages will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWING

In order that the manner in which the above recited and other features and advantages may be obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which:

FIGS. 14A-14D provide front and back views of embodiments of the functional brassiere with the cross strap connector located in back;

Figure 1:
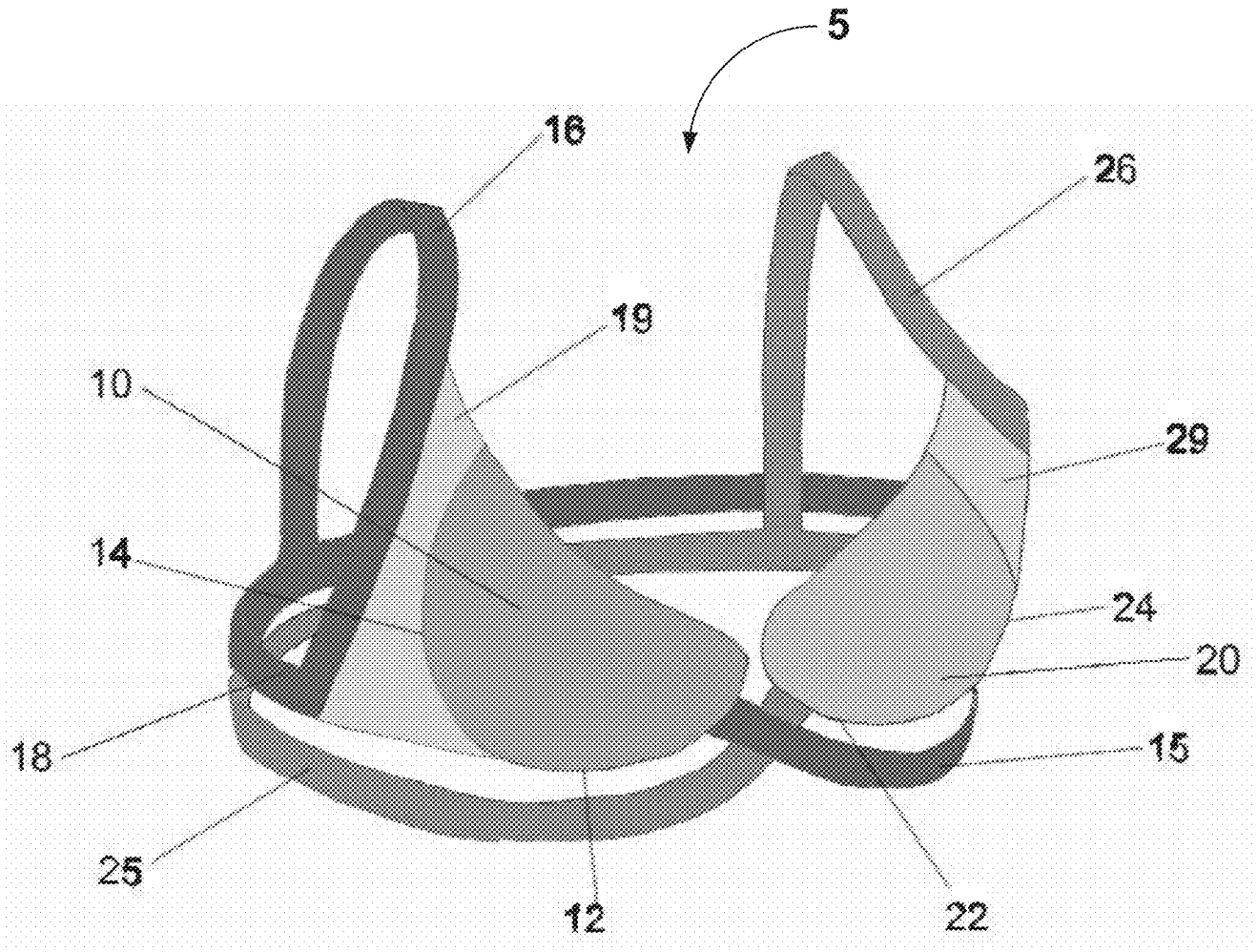
FIG. 1 provides a perspective view of a fastened embodiment of a functional brassiere.

The Figures illustrate specific aspects of some embodiments of the functional brassiere. Together with the following description, the Figures demonstrate and explain the principles of the structures, methods, and principles described herein. In the drawings, the thickness and size of components may be exaggerated or otherwise modified for clarity. The same reference numerals in different drawings represent the same element, and thus their descriptions will not be repeated. Furthermore, well-known structures, materials, or operations are not shown or described in detail to avoid obscuring aspects of the described devices.

As the terms on, attached to, or coupled to are used herein, one object (e.g., a material, a layer, a component, etc.) can be on, attached to, or coupled to another object, regardless of whether the one object is directly on, attached, or coupled to the other object or there are one or more intervening objects between the one object and the other object. Also, directions (e.g., above, below, top, bottom, side, up, down, under, over, upper, lower, horizontal, vertical, "x," "y," "z," etc.), if provided, are relative and provided solely by way of example and for ease of illustration and discussion and not by way of limitation. In addition, where reference is made to a list of elements (e.g., elements a, b, c, etc.), such reference is intended to include any one of the listed elements by itself, any combination of less than all of the listed elements, and/or a combination of all of the listed elements, in any order.

DETAILED DESCRIPTION OF THE INVENTION

The present disclosure relates to functional garments and more specifically to functional brassieres. In particular, some embodiments of the present disclosure relate to systems and methods for providing a functional brassiere configured to increase the visual appearance of a user's breasts, while simultaneously maintaining and/or correcting the user's posture. The description below only lists specific embodiments. The descriptions are to be read in light of what is commonly known in the art. All features or steps commonly known or obvious to be included with this disclosure are to be read into the text of this document. Other configurations or features that are obvious or commonly known are to be deemed as part of the scope of this application.

In the disclosure and in the claims, the term functional brassiere, functional bra, bra, (and variations thereof) may be used to refer to any breast supporting device comprising one or more elements set forth herein. While the functional brassiere may, in some embodiments, comprise a first and second breast supporting device, in other embodiments, the functional brassiere comprises a single breast supporting device.

While the described functional brassiere can have any suitable component that allows it to function as intended, in some cases, it includes a first single breast supporting device comprising a first breast cup configured to support a first single breast of the user, a first breast cup connector, and a first support strap. Additionally, in some embodiments, the first support includes a first shoulder loop, a first connecting panel, and/or a first cross strap. In some cases, the first support simply comprises the first cross strap. Accordingly, in some instances, the terms support strap and cross strap (and variations thereof) may be used interchangeably to refer to one or more pieces of material and/or elements of the functional brassiere that couple to a lateral side of a breast cup (e.g., directly and/or indirectly, such as via a breast cup connector) and that are configured to extend around a portion of a torso of a user to couple (e.g., directly or indirectly) to an inner edge of the same breast cup. In this regard, in some cases, the first breast cup comprises an inner edge configured to be disposed near a medial portion of the user's chest when the user wears the functional brassiere. In other cases, the first breast cup connector can comprise an elastomeric material (or any other suitable material) that can be disposed along a lateral side of the first breast cup. In some cases, a first portion of the first shoulder loop (and/or any other suitable portion of the functional brassiere) can be connected, at least in part, to an upper lateral portion of the first breast cup connector with the first shoulder loop configured to extend over the user's first shoulder. A second portion of the first shoulder loop (and/or any other suitable portion) can be connected, at least in part, to a lower lateral portion of the first breast cup connector and can be configured to extend, at least in part, around a portion of the user's torso. In some embodiments, the first and second portion of the first shoulder loop can be configured to join together to form the first connecting panel. The first connecting panel can extend into (and/or form part of) the first cross strap with the first cross strap configured to extend around a portion of the user's torso and attach to the inner edge of the first breast cup. The functional brassiere can also include a second single breast supporting device that is configured similarly to the first single breast supporting device described above.

In some embodiments, the present system and methods relate to supporting breasts and providing visual enhancement of breasts while simultaneously maintaining or correcting the user's posture. While the described methods can include any suitable steps for supporting breasts and/or providing visual enhancement of breasts while simultaneously maintaining or correcting the user's posture, in some cases, include such methods providing first and/or second single breast supporting devices (as described above), wearing the devices such that the breast cups support the breasts such that the support straps (or cross straps) extend around the user's torso and such that the shoulder loops place force on the user's shoulders to bring the shoulders back and to bring the shoulder blades closer to the medial line of the user's back, and wearing the devices such that the breast cups place force on the breasts to bring the breasts closer to the medial line of the user's chest and to lift the user's breasts.

In some embodiments, methods are provided for supporting breasts and providing visual enhancement of breasts while simultaneously maintaining or correcting the user's posture. Although these methods can be described as a series of steps, it should be noted that these steps can be performed in any order, in groups, simultaneously, with additional steps, with the omission of one or more steps, with any suitable modification, and/or in any combination thereof. A first step can involve placing one or more forces on one or both of the user's shoulders such that at least one of the user's shoulder blades are brought closer to a medial line of the user's back, or closer together along the back of the user. These forces can include one or more forces directed towards the posterior of a wearer's body (e.g., a force that draws or pulls back one or both of the user's shoulders). A second step can include placing one or more forces on one or both of a user's breasts in such a way that one or both of the breasts are brought together and/or lifted (e.g., drawing the breasts towards the medial line of a user and/or enhancing cleavage).

In some embodiments, the forces of the first and second steps described above are countervailing forces of each other. Without being bound by theory, it can be understood that, in accordance with some embodiments, a single breast pulls on the shoulder while the shoulder pulls on the single breast. In some cases, the countervailing forces may not be in the same plane. For example, the body can act as a pulley to change the direction of the countervailing forces around it. In other embodiments, a pulling force is applied to an inner portion of the second breast and the second shoulder with the direction of force being changed around a first side of the user's body. A second pulling force may also be applied to an inner portion of the first breast and the first shoulder, the direction of force being changed around a second side of the user's body (e.g., by utilizing a support strap extending around the user's torso to connect an inner portion of a breast cup that is closer to the medial line of the user's chest to the corresponding shoulder). Additionally, the applied forces can cause the inner breasts to press against each other, thereby enhancing cleavage. In some embodiments, one or more secondary shoulder forces are also applied to the user. These secondary shoulder forces can work in cooperation with or independently of the first shoulder forces described above. These secondary shoulder forces can exert a force to draw one or more shoulders posterior and/or to draw the shoulder blades closer together (e.g., by utilizing a shoulder loop configured to attach to the top of the breast cup, loop over the superior portion of the user's shoulder, and to connect to the cross strap extending along the user's back). The cross strap (which may also be referred to as a support strap) extending along a portion of the user's back may be as described above or below.

In some embodiments, one or more forces applied to a single breast are applied via a bra pad of the functional bra. Although in some embodiments, the bra pad is substantially fixed in location with respect to the breast cup, in some other embodiments the bra pad is configured to move independently of the breast cup. In such embodiments, the one or more shoulder forces may still be applied by a support strap connected to the lateral side of the breast cup. Additionally, in some such embodiments, the countervailing nature of the forces are still maintained, even if the bra pad moves while the cup remains substantially static or moves minimally. For example, a portion of the outer distal breast may provide the necessary resistance to slip and/or a non-slip material in the bra pad or along the cross strap (or support strap) may be used to provide the necessary resistance.

Figure 9B:
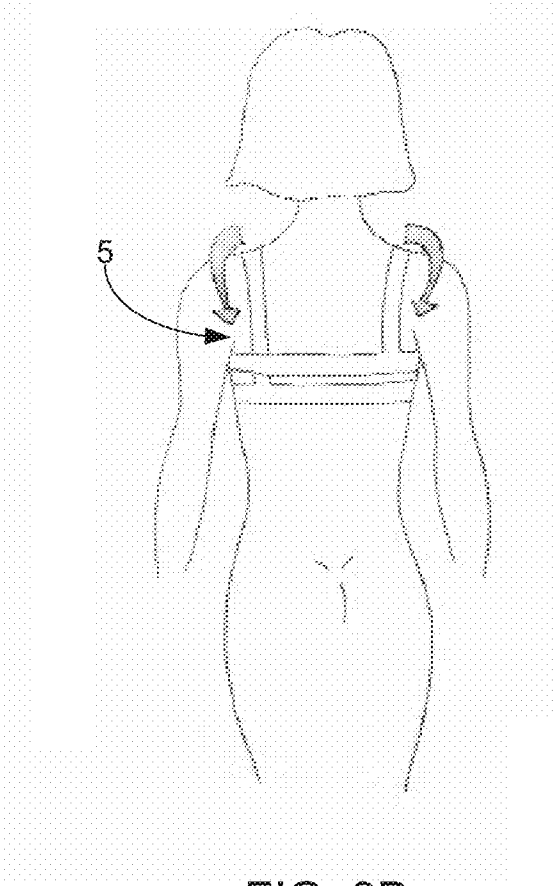
FIGS. 9A-9B respectively provide a front and back view of an embodiment of the brassiere, depicting some embodiments of directional forces.
Figure 9A:
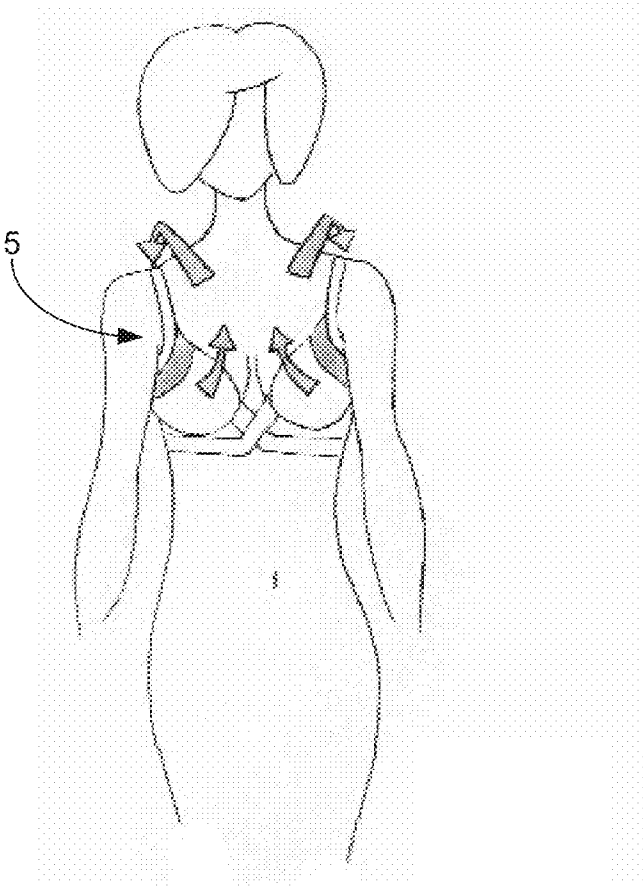

In some embodiments, the one or more forces applied to the user by the functional brassiere are visualized as shown in FIGS. 9A-9B. The forces may be applied in the direction of the arrows. FIG. 9A shows the one or more forces that may be applied to a front side of the user. For example, the one or more forces may elevate the breasts and/or draw them together to enhance cleavage. The one or more forces may also draw the user's shoulders back. FIG. 9B illustrates one or more forces that may be applied to a back view of the user. For example, the one or more forces may draw the user's shoulders back and/or may draw the user's shoulder blades together and closer to a medial portion of the user's back.

In general (and as mentioned above), some embodiments of the described systems and methods relate to a functional brassiere configured to increase the visual appearance of a user's breasts while simultaneously maintaining or correcting the user's posture. While the functional brassiere can comprise any suitable component or characteristic that allows it to function as intended, FIG. 1 shows that, at least in some embodiments, the functional brassiere 5 comprises a first breast cup 10 and a second breast cup 20, hereinafter generally referred to as the breast cup and/or the breast cups.

The breast cups can comprise any suitable material and can be configured in any suitable manner. For example, each breast cup can be configured to conform to at least a portion of a user's breast and/or to support at least a portion of the user's breast. In some cases, the breast cup can cover the entire breast or a portion of the breast. In some embodiments, the breast cup is configured to cover an outer (e.g., lateral) and a lower portion of the breast to leave a portion of the breast exposed for increasing a wearer's appearance while providing adequate support and coverage. The first breast cup 10 may further comprise a first lower inner edge 12 and a first upper outer (or lateral) edge 14. The second breast cup 20 may further comprise a second lower edge 22 and a second upper (or lateral) edge 24.

With continued reference to FIG. 1, in some embodiments, the functional brassiere 5 further comprises a first shoulder loop 16 and a second shoulder loop 26. While the first shoulder loop 16 and the second shoulder loop 26 can comprise any suitable material and can be configured in any suitable manner that allows them to function as intended, at least in some embodiments, the first shoulder loop 16 and the second shoulder loop 26 are configured to connect to the first breast cup 10 and second breast cup 20, respectively, via a first breast cup connector 19 and a second breast cup connector 29, respectively. Alternatively, the first shoulder loop 16 and second should loop 26 may connect directly to the first breast cup 10 and the second breast cup 20, respectively.

Figures 8A, 8B:
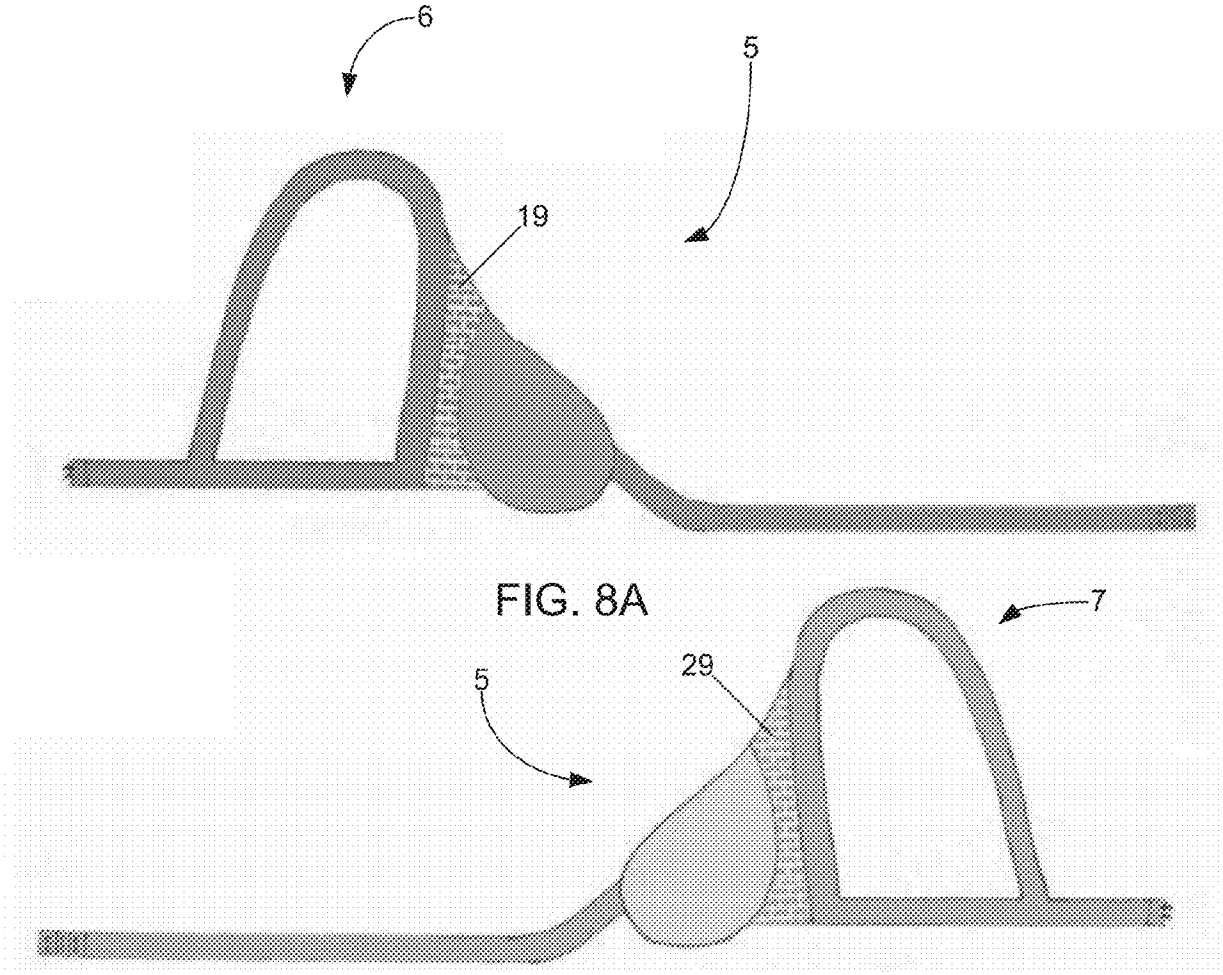
FIGS. 8A-8B provide front views of representative embodiments of the invention.

While the first breast cup connector 19 and the second breast cup connector 29 can comprise any suitable material and can be configured in any suitable manner that allows them to function as intended, at least in some embodiments, the first breast cup connector is configured to attach to the first upper (or lateral) edge 14 and the second breast cup connector is configured to attach to the second upper (or lateral) edge 24. In some embodiments, at least a portion of the second breast cup connector 29 is attached to the second upper edge 24. Although, in some embodiments, the first 19 and/or second 29 breast cup connectors comprise one or more non-stretchable materials, in some other embodiments, the first breast cup connector 19 and the second breast cup connector 29 comprise an elastomeric and/or stretchable material (e.g., as shown in FIGS. 8A-8B) configured to allow the functional brassiere to increase the visual appearance of a user's breasts while simultaneously maintaining or correcting the user's posture. In other embodiments, the first breast cup connector 19 and the second breast cup connector 29 comprise one or more elastomeric materials (e.g., rubber, elastic, Spandex, LYCRA®, Elastane, synthetic fiber, DARLEXX®, and/or any other suitable elastomeric material). In yet other embodiments, the elastomeric materials are configured to stretch and/or shrink to conform to the user's movements. In some embodiments, the elastomeric materials are configured to distribute forces applied at a first end (e.g., the end attached to the lateral edge of the breast cup) to a second end (e.g., the end attached to the shoulder straps). In other embodiments, the first breast cup connector 19 and the second breast cup connector 29 comprise an elastomeric material possessing a lower elastic modulus than one or more other components of the functional brassiere.

In some embodiments, the shoulder loops comprise a resilient and/or hard stretch material (e.g., cloth, strapping, nylon, synthetic fabric, cord, webbing, mesh, and/or any other suitable material). Indeed, in some embodiments, the shoulder loops are non-stretchable and/or are less stretchable than the material used in the breast cup connectors. The shoulder loops can also be configured to allow the user to comfortably pass her arm through openings created by the shoulder loops. The shoulder loops can also be configured to provide the above-described forces to apply sufficient force on the shoulders. In some cases, the applied force may be capable of pulling one or more of the shoulders back so that the user's shoulder blades are drawn closer together. In other cases, the shoulder loops can be configured to reduce stoop in the user.

Figures 3A, 3B, 3C:
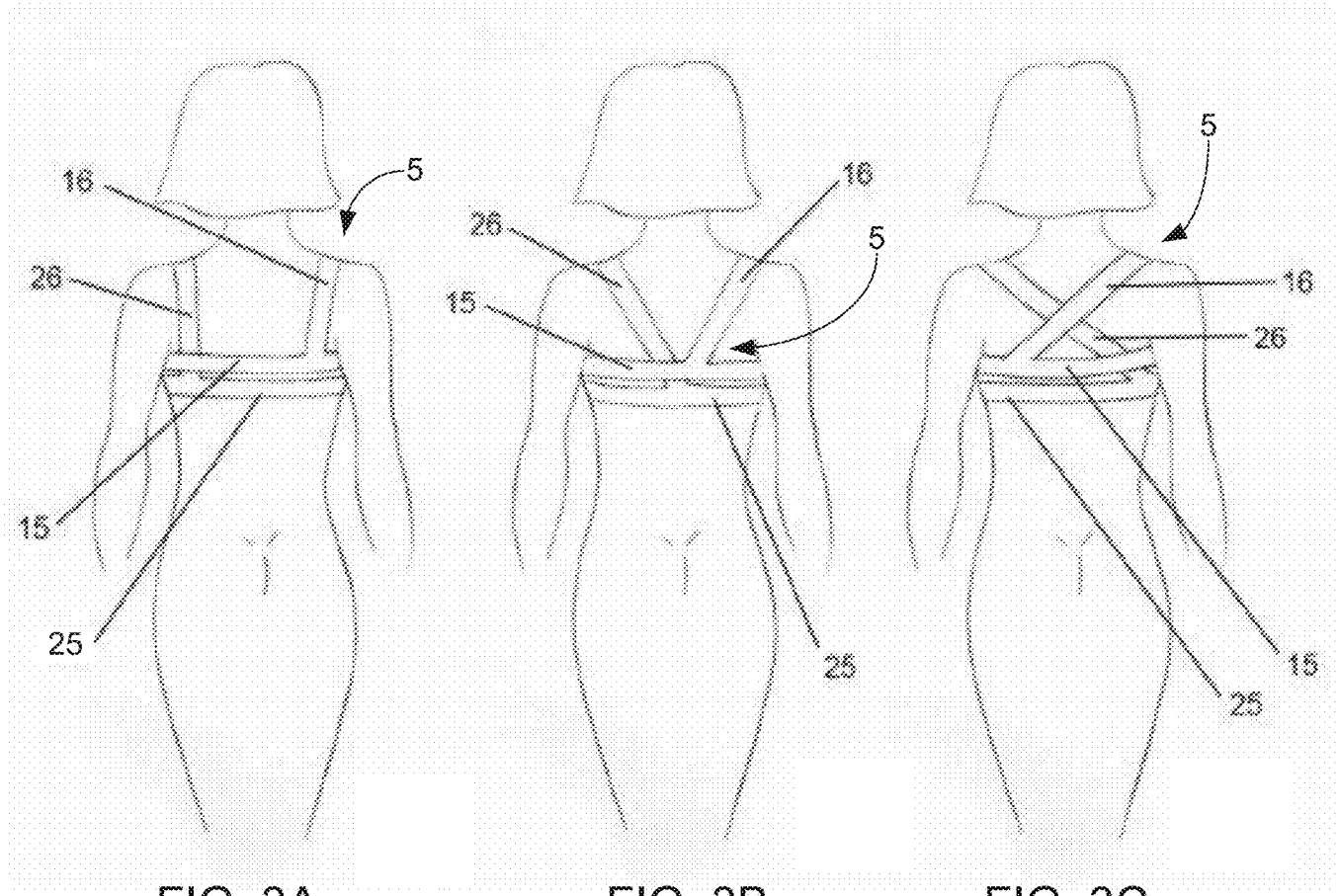
FIGS. 3A-3C each provide a back view of a different embodiment of a shoulder strap configuration.

While the first shoulder loop 16 and the second shoulder loop 26 can be configured in any suitable manner that allows them to function as intended, at least in some embodiments, the first shoulder loop 16 and the second shoulder loop 26 are configured to balance orthopedic value, to provide user comfort, and to enhance breast visual appearance. FIGS. 3A-3C illustrate some embodiments of the shoulder loops 16 and 26. In some embodiments, the shoulder loops configurations can be configured to attach to the cross straps (or support straps) and/or breast cup connector in any suitable manner. In some cases, the shoulder loops is configured to attach to the respective cross strap (e.g., 15 or 25) (or support strap) in a substantially perpendicular fashion (e.g., a substantially rectangular configuration, as shown in FIG. 3A). In other cases, the shoulder loop can be configured to attach to the respective cross strap (e.g., 15 or 25) at an angle approaching the middle of the user's back (e.g., a substantially V-shaped configuration, as shown in FIG. 3B). In yet other cases, the shoulder loop is configured to attach to the respective cross strap (e.g., 15 or 25) such that the shoulder straps intersect (e.g., the substantially X-shaped configuration, as shown in FIG. 3C). The described configurations may not necessarily conform to the exact shape described by the identifying label (e.g., the X-shaped configuration may not necessarily be a perfectly shaped X).

In some instances, each shoulder strap configuration may have certain advantages and may have certain drawbacks. For example, some embodiments of the rectangular shoulder loop configuration, shown in FIG. 3A, may sacrifice some orthopedic benefit in order to allow the user to increase the visual appearance of her back, thereby allowing for her back to be at least partly exposed. Some embodiments of the V-shaped shoulder loop configuration, shown in FIG. 3B, provide more orthopedic effect than do some embodiments of the rectangular shaped configuration. Some embodiments of the X-shaped shoulder loop configuration, shown in FIG. 3C, provide more orthopedic benefit than do some embodiments of either the rectangular shape configuration or the V-shaped configuration, but may prevent the user from exposing her back because the shoulder straps would be revealed. While the above described shoulder loop configurations are some examples of possible shoulder loop configurations, the shoulder loop configuration examples are not to be considered as limiting because the shoulder loops may be configured in any suitable manner that allows the functional bra to function as intended. As described above, the shoulder loops may be attached to the breast cups (e.g., 10 and/or 20) either directly or may be attached to the breast cup connectors (e.g., 19 and/or 29).

In some embodiments, one or more of the shoulder loops 16 and/or 26 comprise one or more shoulder loop fasteners (not shown). While the shoulder loop fasteners can comprise any suitable material and can be configured in any suitable manner, at least in some embodiments, the shoulder loop fasteners are configured to allow the user to adjust the configuration of the shoulder loops. In other embodiments, the shoulder loop fasteners are configured to allow the user to adjust a length and/or a tension of the shoulder loop. In yet other embodiments, the shoulder loop fasteners allow the user to put on and/or remove the functional brassiere. The shoulder loop fasteners can comprise any suitable fastener (e.g., clasps, buttons, fasteners, snaps, zippers, clips, ties, buckles, tacks, hook-and-eye closure, stitches, pins, hook and loop fasteners, and/or any other suitable fastener).

In some embodiments, the shoulder loop fasteners comprise hook and loop fasteners (e.g., VELCRO®). The hook and loop shoulder loop fastener can be arranged in any suitable configuration. In general, the hook and loop fastener can comprise a lineal fabric strip with tiny hooks (hook portion) that is configured to detachably attach with another lineal fabric strip comprising tiny loops (loop portion). In some embodiments, one or more hook portions run along a portion of the lower shoulder loop strap and one or more loop portions run along a shoulder portion of the shoulder loop. In some other embodiments, one or more hook portions can be placed on a shoulder part of the shoulder loop while a loop portion runs along a portion of the lower shoulder loop strap. This hook and loop configuration can allow for adjustable positioning of the shoulder loop to accommodate the user's specific orthopedic needs (e.g., shortening or lengthening the shoulder loop). In other embodiments, the hook portion is placed on an end of the shoulder loop and the loop portion is placed along a portion of the cross strap) to allow a user to detachably attach the shoulder loop along the cross strap (or support strap). Utilizing this hook and loop fastener configuration can allow for the user to position the shoulder strap along the cross strap such that the user can tailor the shoulder strap configuration to her specific orthopedic needs, while leaving the ability to also tailor to her comfort and beauty needs. For example, the user can detachably attach the shoulder straps to the cross straps to achieve a rectangular configuration that allows for the user to wear clothing with an open back. Likewise, the user can detachably attach the shoulder straps to the cross straps to achieve an X-shaped configuration to enjoy greater orthopedic support.

Figure 2:
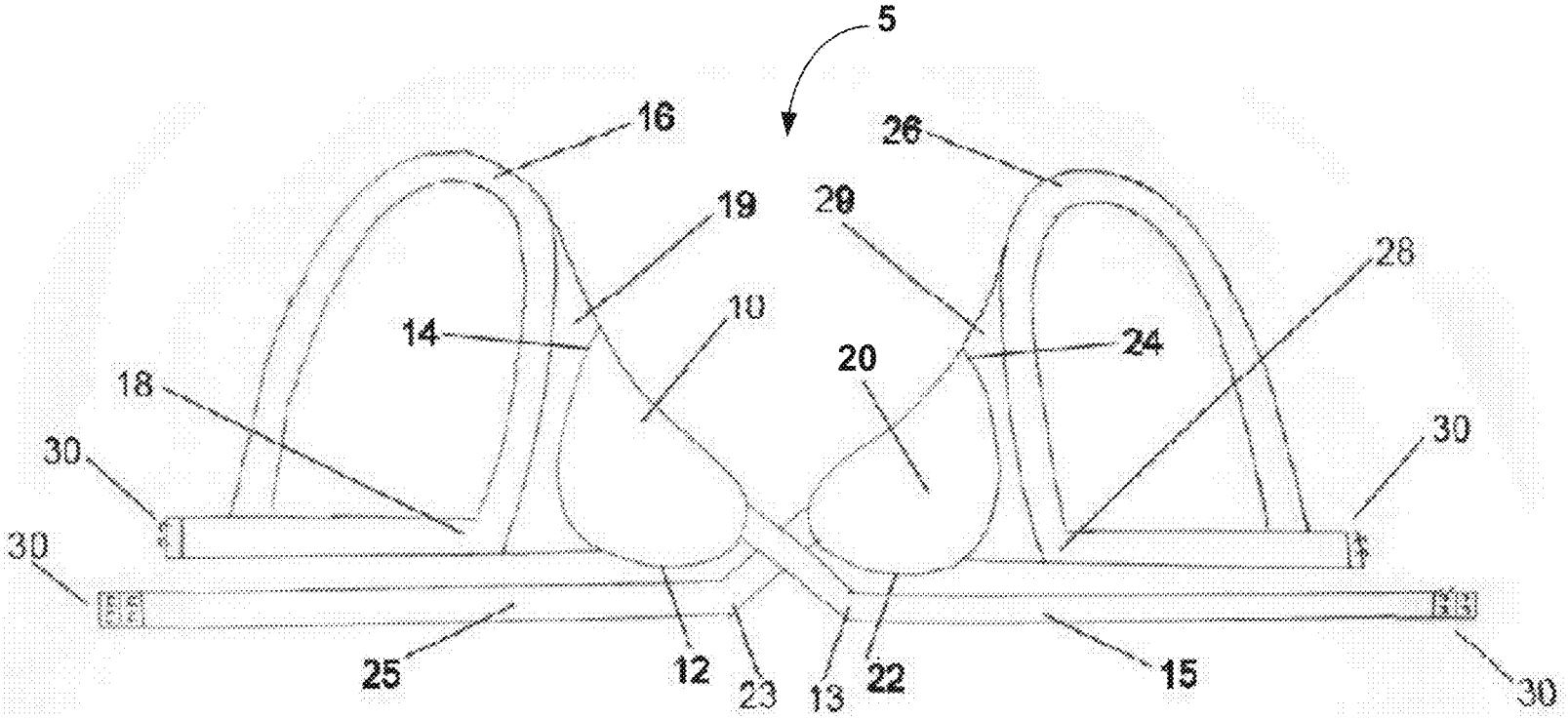
FIG. 2 provides a spread out view of an embodiment of the brassiere.

Referring now to FIGS. 1 and 2, in some embodiments, the functional bra 5 comprises cross straps 15 and/or 25 (or support straps) that comprise any suitable material and that are configured in any suitable manner that allow the functional bra to function as intended. FIG. 1 shows an embodiment of a first cross strap 15 and a second cross strap 25. While the cross straps can be connected in any suitable fashion, at least in some embodiments, one end of the cross strap is connected to the inner medial portion of the breast cup (e.g., 10 and/or 20) while another end is connected to the outer lateral portion of the same breast cup. For example, one end of the first cross strap 15 may be connected to the lower first inner edge 12 of the first breast cup 10 and an opposite end of the first cross strap 15 may be connected to the first upper outer edge 14 of the breast cup, either directly or via the first breast cup connector 19 (and/or via a separate shoulder loop).

In some embodiments, the cross strap (e.g., 15 and/or 25) is attached in any suitable manner to the breast cup (e.g., 10 and/or 20). For example, one end of the cross strap can attach to at least a portion, or the entire portion, of the outer lateral edge (e.g., edge 14) of the breast cup or breast cup connector. For example, in some embodiments, the second cross strap end 28 connects to a bottom portion of the second breast cup connector 29. Likewise, the first cross strap end 18 can connect to a bottom portion of the first breast cup connector 19. In some embodiments, the connection of the first cross strap and the connection of the second cross strap differ. For example, the location of the second cross strap end 28 connection to the second breast cup 20 (or second breast cup connector 29) may differ from the location of the first cross strap end 18 connection to the first breast cup 10 (or the first breast cup connector 19). For example, the first cross strap end 18 can be attached at a location above the second cross strap 28.

In some embodiments, the cross strap (e.g., 15 and/or 25) comprises a cross strap angling. While the cross strap angling can comprise any suitable configuration, at least in some embodiments, it comprises an angled (or curved) portion of the cross strap. The angled portion of the cross strap can be configured at any suitable location along the cross strap (e.g., proximal to the breast cups, along a lateral portion, and/or along a back portion). In some embodiments, the cross strap angling is configured to be located at a portion of the cross strap near the cross strap connection to the inner (e.g., medial) edge of the breast cup. FIG. 2 illustrates some embodiments of a first cross strap angling 13 and a second cross strap angling 23. In some embodiments, the degree of angling (and/or curvature) of the cross strap angling is configured to allow for properly enhancing the visual appearance of the breast while still providing sufficient orthopedic benefit and comfort. While the cross strap angling can comprise any suitable angle (and/or curvature), at least in some embodiments, the upper superior angle of the cross strap angling is an obtuse angle. In some embodiments, the obtuse angle between portions of the cross strap is between about 90 and about 170 degrees. In other embodiments, the obtuse angle is between about 90 and about 150 degrees. In yet other embodiments, the obtuse angle is between about 110 and about 145 degree.

Referring now to FIG. 2, in some embodiments, the cross strap (or support strap) optionally comprises one or more cross strap fasteners 30. While the cross strap fasteners 30 can comprise any suitable configuration and/or any suitable materials that allow the functional bra to function as intended, at least in some embodiments, the cross strap fasteners are configured to detachably couple a portion of the cross strap. The cross strap fastener can comprise any suitable fastener for coupling a portion of the cross strap (e.g., one or more clasps, buttons, fasteners, snaps, zippers, clips, ties, buckles, tacks, hook-and-eye closures, stitches, pins, hook and loop fasteners, and/or any other suitable fasteners). In some embodiments, the cross strap fastener can comprise a hook and loop fastener (e.g., VELCRO®).

Figure 4C:
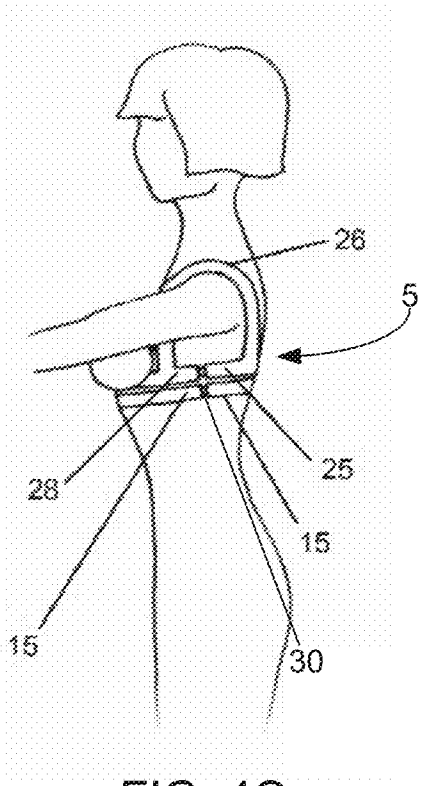
FIGS. 4A-4C each provide a different view of a different embodiment of a cross strap fastener location.
Figure 4B:
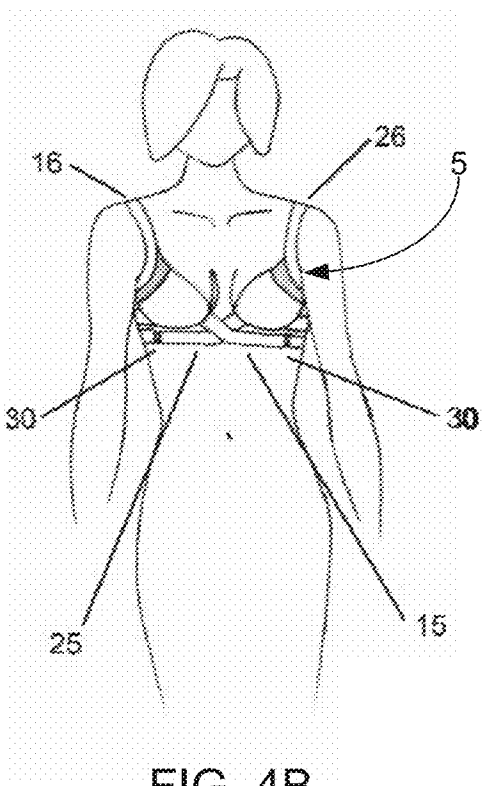
Figure 4A:
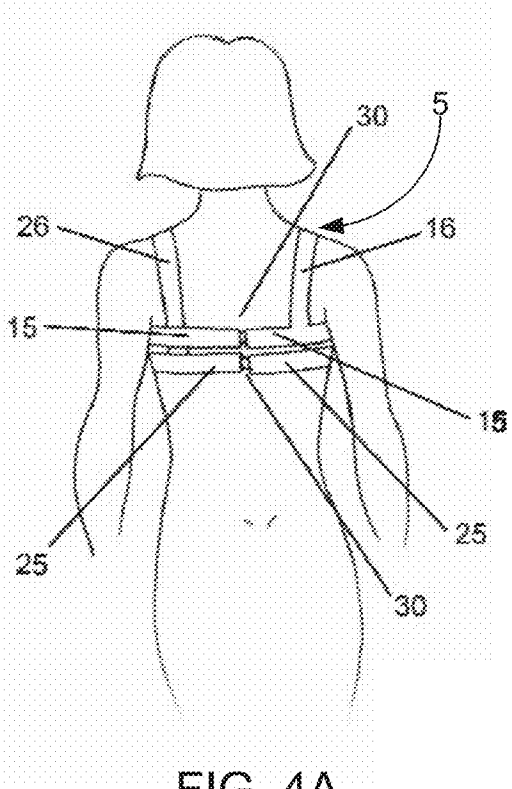

Referring now to FIGS. 4A-4C, in some embodiments, the cross strap fastener 30 can be located at any suitable location along the cross strap that allows the functional bra 5 to function as intended. For example, the cross strap fastener can be located, without limitation, at a location proximal to one or more of the breast cups, at a location at the front chest of the user, at a location along a lateral portion of the user, and/or at a location along the back of the user. As shown in FIG. 4A, at least in some embodiments, the cross strap fastener 30 is located at approximately the middle of the user's back. In some embodiments, this placement can allow the cross strap fastener to be located approximately half way along the length of the cross strap. FIG. 4B shows an embodiment in which the cross strap fastener 30 is located along the cross straps at a location at the front chest (and/or side torso) of the user. The cross strap fastener can be located at the front of the user's body and below the breast cups. FIG. 4C shows at least one embodiment in which the location of the cross strap fasteners 30 is configured to be disposed along a single lateral portion of the user's body. In other embodiments, the cross strap fastener of each cross strap is located along a single lateral side of the user. In some embodiments, the placement of both cross strap fasteners along a single common lateral side of the user causes the location of each individual cross strap fastener to be at a different relative location along the respective cross strap. FIG. 4C shows at least one embodiment in which the location of the cross strap fasteners 30 is along a single common lateral side of the user. The first cross strap fastener 30 can be located along the end of the first cross strap end 18 and the second cross strap fastener 30 can be located along the second cross strap 15 at a relative location closer to the cross strap connection to the breast cup (or breast cup connector). In some embodiments, the cross strap fasteners are configured to be located along the user's left lateral side. In other embodiments, the cross strap fasteners are configured to be located along the user's right lateral side. In still other embodiments, one cross strap fastener is configured to be disposed on a user's right side while another fastener is configured to be disposed on a left side.

Figure 4E:
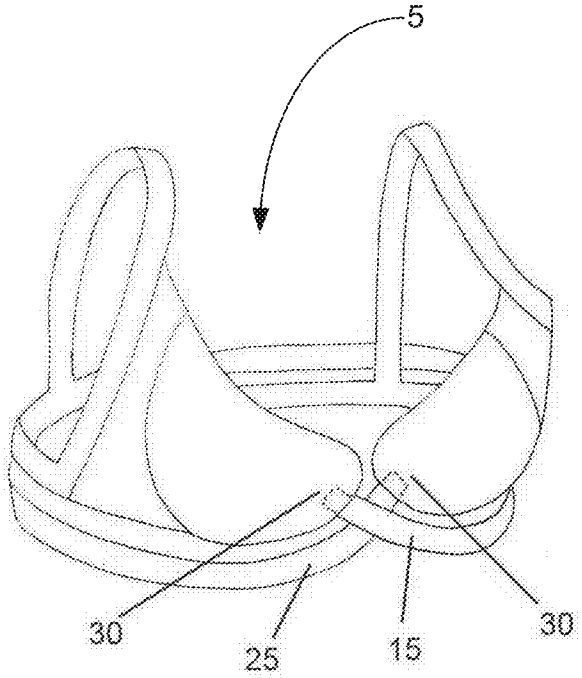
FIGS. 4D-4E each provide a perspective view of a representative embodiment of the brassiere.
Figure 4D:
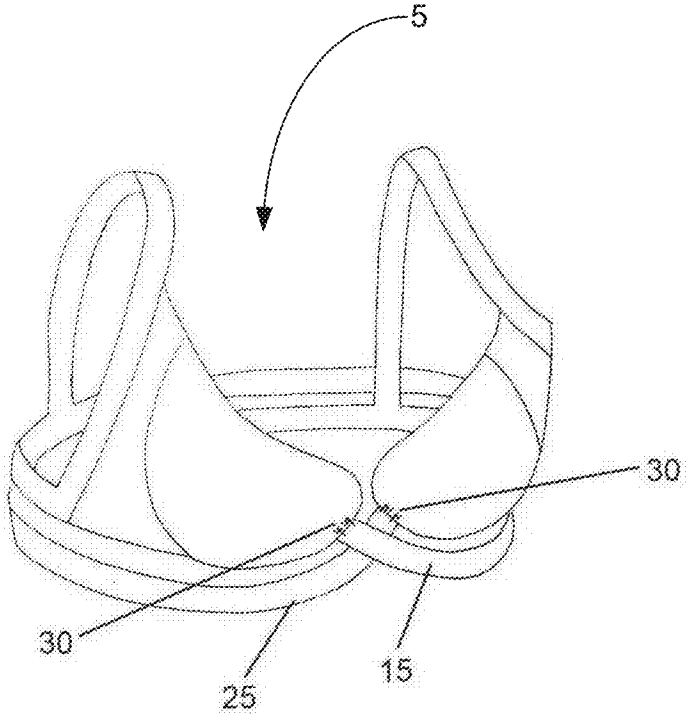

Referring now to FIGS. 4D and 4E, in some embodiments, the cross strap fasteners (e.g., 30) are configured to directly attach the cross straps (e.g., 15 and/or 25) to the breast cups (e.g., 10 and/or 20). While the cross strap fasteners can be configured to attach the cross straps to the breast cups in any suitable manner, at least in some embodiments, the cross strap fasteners are configured to directly fasten the cross straps to the lower inner edges of the beast cups. FIG. 4D illustrates some embodiments of cross strap fasteners 30 configured to directly fasten the cross straps 15 and/or 25 to the lower inner edges of the beast cups. In some embodiments, the cross strap fasteners are configured to connect to an interior side of the breast cups. FIG. 4E illustrates some embodiments of cross strap fasteners configured to connect to an interior side of the breast cups. The cross strap fasteners can be configured in any suitable manner to connect to an interior side of the breast cups (e.g., by providing a hook and loop fastener, such as VELCRO®, to one end of the cross straps and to a portion of the interior side of the breast cups).

Figures 5A, 5B:
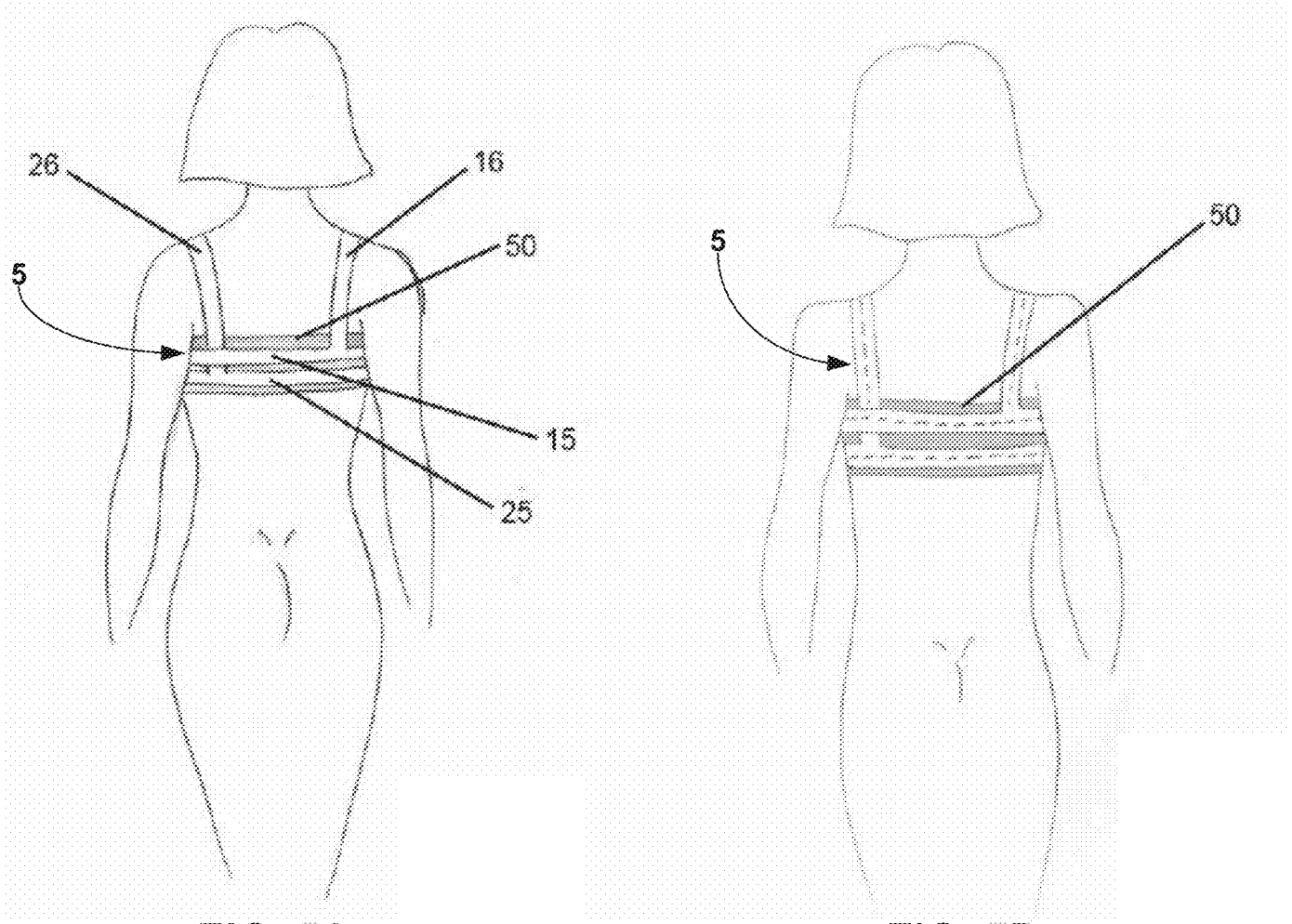
FIGS. 5A-5B each provide a back view of an embodiment of a cross cut band.

Referring now to FIGS. 5A-5B, in some embodiments, the functional bra 5 comprises one or more cross cut bands 50. While the cross cut band 50 can be configured in any suitable manner and can comprise any suitable material(s) to allow the functional bra to function as intended, at least in some embodiments, the cross cut band 50 is configured to circumscribe a torso of the user below the breasts and across the user's mid back. In some embodiments, the cross cut band is configured to improve the function of the functional bra, including, but not limited to, augmenting breast visual appearance and increasing the ability to form various shoulder loop configurations.

In other embodiments, the cross cut band 50 is configured to be attached to one or more of the cross straps 15 and/or 25 (or support straps) and/or the shoulder straps 16 and/or 26. In yet other embodiments, the cross cut band is configured with one or more channels configured to selectively receive one or more of the cross straps and the shoulder straps. The channels can be configured to allow the cross straps and/or shoulder straps to move relative to (and/or independently of) the cross cut band such that the cross cut band does not impair the distribution and/or application of forces by the functional bra to enhance breast appearance and/or to improve support and posture. In some embodiments, the cross straps and/or shoulder straps can be replaced at least in part by cording, strapping, webbing, tubing, and/or any other suitable material configured to traverse the channel(s). In some embodiments, the cross cut band comprises a stretchable and/or non-stretchable material configured to allow the functional brassiere to increase the visual appearance of a user's breasts while simultaneously maintaining or correcting the user's posture. Indeed, in some embodiments, the cross cut band optionally comprises one or more elastomeric materials (e.g., rubber, elastic, Spandex, LYCRA®, Elastane, synthetic fiber, DARLEXX®, and/or any other suitable stretchy and/or resilient material). In some embodiments, the elastomeric materials are configured to stretch and/or shrink to conform to the user's movements. In still other embodiments, the cross cut band comprises an elastomeric material possessing a lower elastic modulus than one or more other components of the functional brassiere (e.g., the breast cup connector and/or any other suitable portion).

Figure 6:
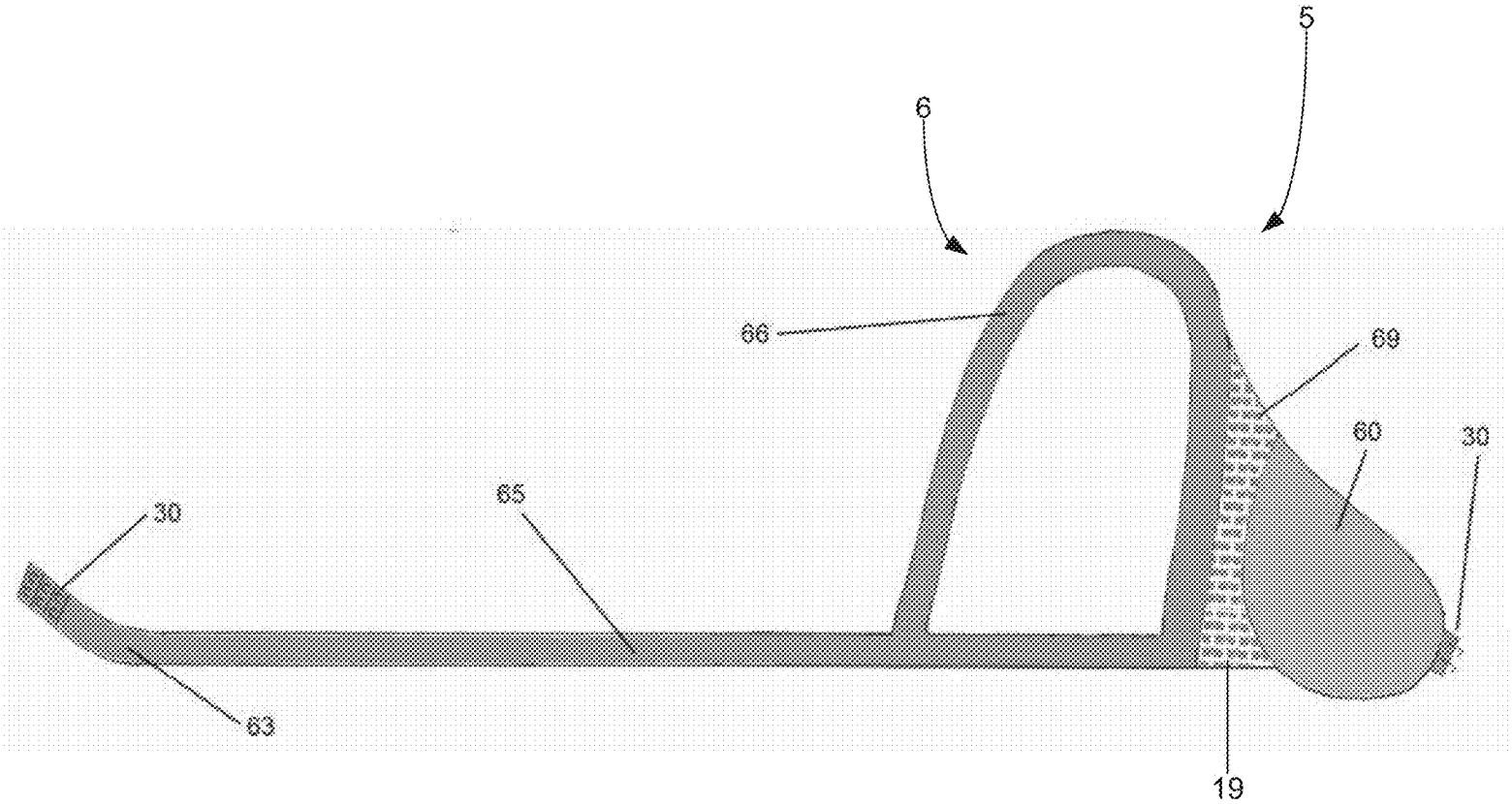
FIG. 6 provides a front view of an embodiment of the brassiere.

Referring now to FIG. 6, an embodiment of the functional brassiere 5 is illustrated. While the functional brassiere can include any suitable component and/or any suitable configuration that allows the functional bra to function as intended, at least in some embodiments, the functional brassiere comprises a first single breast supporting device and/or a second single breast supporting device. In some embodiments, the single breast supporting device is configured to function independently to increase the visual appearance of one of a user's breast while simultaneously maintaining or correcting the user's posture. FIG. 6 illustrates some embodiments comprising a first single breast supporting device 6. The single breast supporting device can be configured as described to increase the visual appearance of a user's single breast while simultaneously maintaining or correcting the user's posture. The single breast covering device can also be configured to assist in correcting the user's posture and/or stoop in the corresponding shoulder while simultaneously enhancing the visual appearance of the user's breast on the same side of the body as the shoulder being corrected.

As shown in FIG. 6, some embodiments of a single breast supporting device 6 comprise a single first breast cup 60. While the single first breast cup can be configured in any suitable manner and can comprise any suitable materials, at least in some embodiments, the first breast cup is configured to support a first breast. In some embodiments, a first shoulder loop 66 is attached to one side of the first breast cup 60 either directly or via the first breast cup connector 69. A first cross strap 65 (or support strap) can also be connected to one side of the single first breast cup, either directly or via the single first breast cup connector. In other embodiments, the first cross strap 65 comprises a first cross strap angling 63. The first cross strap angling 63 can be configured to be located in any suitable location on the cross strap (e.g., proximal to the first breast cup 60). In yet other embodiments, the cross strap 65 comprises a cross strap fastener 30. The cross strap fastener 30 can be configured in any suitable manner and can comprise any suitable materials, as described above. In some embodiments, the cross strap fastener is configured to connect the cross strap to the inner medial edge of the single breast cup 60.

Figure 7:
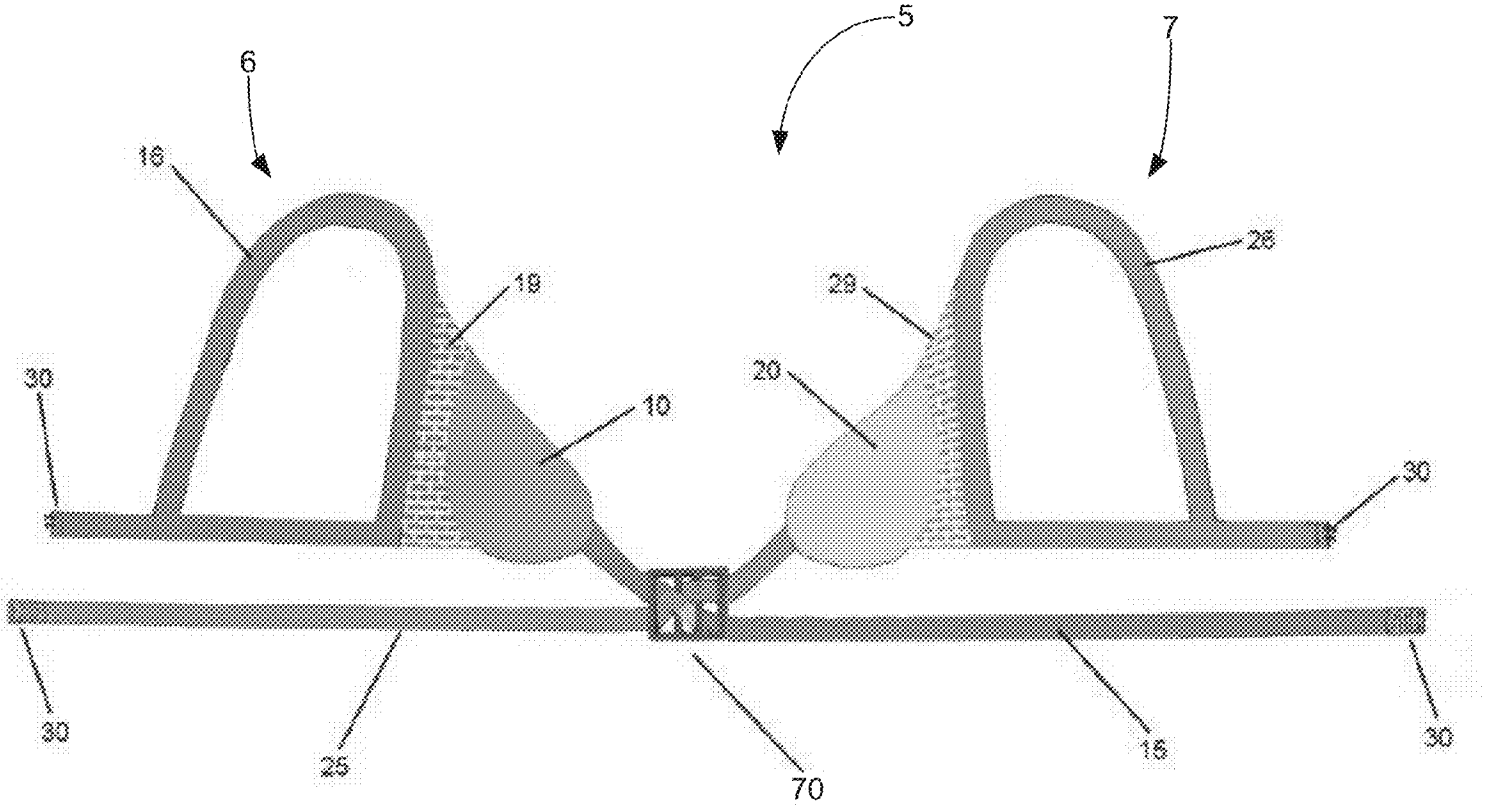
FIG. 7 provides a front view of the bra comprising a buckle in accordance with some embodiments.

The first single breast supporting device 6 can also be configured as described to function in conjunction with a second single breast supporting device to increase the visual appearance of a user's breast, while simultaneously maintaining or correcting the user's posture, as shown in FIGS. 9A-9B. In some embodiments, the user can wear a second single breast supporting device with the second single breast supporting device 7 configured as a mostly mirror image of the first single breast supporting device 6, as shown in FIGS. 7-8B. In other embodiments, the first single breast supporting device can also be configured as described to function in conjunction with a second single breast supporting device to increase the visual appearance of the user's breasts by elevating the breasts and/or by drawing the breasts together to enhance cleavage.

Referring now to FIG. 7, some embodiments of a functional brassiere 5 comprising a first single breast supporting device 6 and a second single breast supporting device 7 are shown. While the functional brassiere comprising a first single breast supporting device and a second single breast supporting device can be configured in any suitable manner and can comprise any suitable materials that allow the functional bra to function as intended, at least in some embodiments, the functional brassiere comprises a coupling device configured to couple the first single breast supporting device and a second single breast supporting device together. The coupling device can be configured to couple the first single breast supporting device and a second single breast supporting device together in any suitable manner. In some embodiments, the coupling device 70 is configured to couple the cross straps (or support straps) together. In some embodiments, the coupling device 70 is configured to allow for adjustment of the cross straps to provide enhanced breast appearance. Additionally, in some embodiments, the coupling device 70 is configured to couple the cross straps together at a location where the first cross strap 15 and the second cross strap 25 overlap. In some instances, the coupling device can be configured to be located on the cross straps between and below the breasts, along the medial line of the user's body. In other instances, the coupling device may be configured to allow the user to adjust the support and/or configuration of a single breast independently of the other breast. The coupling device 70 can comprise any suitable coupler (e.g., one or more buckles, clasps, butterfly clasps, tensioners, fasteners, snap-fit buckles, hooks and loop fasteners, buttons, snaps, zippers, clips, ties, hook-and-eye closures, and/or any other suitable couplers).

Figure 10:
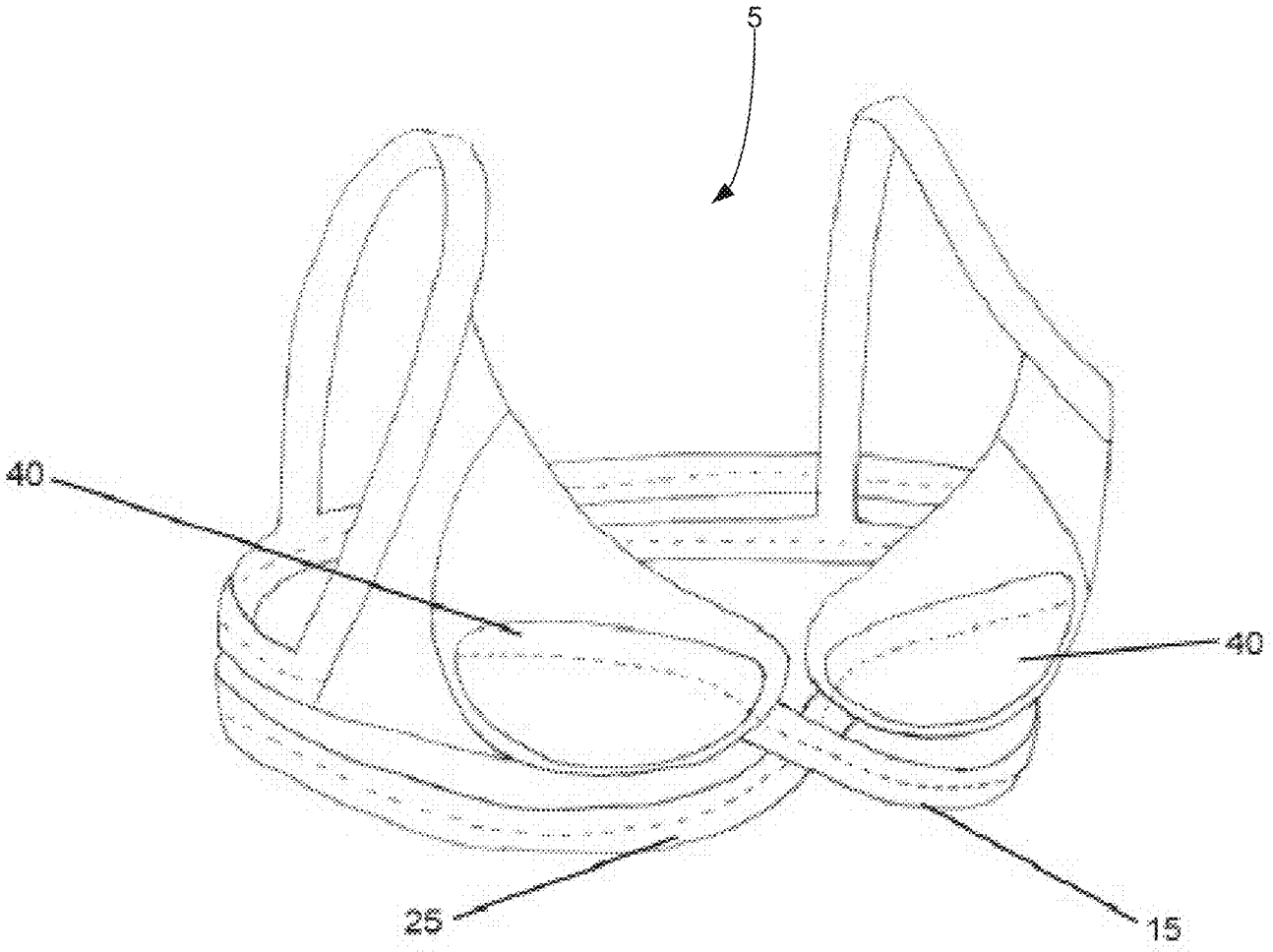
FIG. 10 provides a perspective view of an embodiment of a supporting and/or shaping structure.

Referring now to FIG. 10, some embodiments of a supporting structure (or support structure) 40 are shown. While the first breast cup 10 and the second breast cup 20 may comprise any suitable component and may be configured in any suitable manner that allows the functional brassiere to function as intended, at least in some embodiments, the breast cup comprises a support structure 40. The support structure 40 can be configured to function with the breast cup to support, elevate, accentuate, pad and/or shape the user's breast. The support structure 40 can comprise any suitable component and can be configured in any suitable manner. In some embodiments, the support structure 40 comprises a pad, an underwire, and/or any other suitable component to visually enhance the size and/or shape of a user's breast. In other embodiments, the support structure 40 is configured as an integral component of the breast cup. In some cases, the support structure 40 is optionally configured to be detachably attached to the breast cup.

In some embodiments, the support structure 40 is configured to be attached to one of the cross straps 15 or 25 (or support straps). In other embodiments, the first 15 or 25 second 25 cross straps are attached to a corresponding support structure 40 (e.g., to an inside portion of the support structure 40) in such a way that the support structure 40 moves when the corresponding cross strap 15 or 25 is pulled, but the breast cup remains relatively static or moves less than the cross strap. A benefit of this configuration is that the breasts are visually enhanced by the improvement in the push-up effect applied to the breasts. Also, this configuration can enhance the visual appearance of the breast by creating additional cleavage while the breast cup and/or support structure 40 maintain a full looking breast, especially, in some embodiments, along the outer distal and/or lower inferior side of the breast.

With respect to the materials comprising the functional bra 5, the functional bra can comprise any suitable material(s) that allow it to function as intended. Indeed, in some embodiments, the functional brassiere comprises fabric, textile, leather, plastic, nylon, polyester, nylon, acrylic, acetate, wire, synthetic, cotton, latex foam, natural fiber, foam, metal underwire, plastic underwire, lace, mesh, microfiber, strapping, webbing, cording, rubber, elastic, spandex, LYCRA®, Elastane, synthetic fiber, DARLEXX®, elastomeric materials, and/or any other suitable material. In other embodiments, the functional brassiere comprises a blend of materials configured to allow it to function as intended. For example, the functional brassiere can comprise a blend of materials with some materials comprising a higher elastic modulus (e.g., "stiffer" materials) and some materials comprising a lower elastic modulus (e.g., elastic or "stretchy" materials). The blend of stiff and stretchy can be configured to function in a synergetic manner to allow the functional bra to function as intended. For example, as described above, the breast cup connector can comprise one or more elastomeric materials configured to distribute forces applied at a first end (e.g., the end attached to the lateral edge of the breast cup) to a second end (e.g., the end attached to a corresponding shoulder strap), while a component such as the shoulder strap can comprise materials that do not stretch (or do not stretch as much as the breast cup connector). Similarly, the cross cut band can comprise one or more elastomeric materials that are configured to substantially conform to the user's torso while having a lower elastic modulus that is configured to provide support for the user without compromising the functional nature of the functional brassiere. Likewise, the breast cup can comprise a blend of stretchy materials (e.g., spandex) with less stretchy materials (e.g., synthetic foam) to provide comfort, support, and/or shaping to the breast.

While the various components of the functional brassiere 5 can comprise any suitable elasticity in relation to each other, in some embodiments, the breast cup connectors (e.g., 19 and 29) are more elastic than are the cross straps (e.g., 15 and 25 or support straps), the breast cups (e.g., 10 and 20), the shoulder straps (e.g., 16 and 26), and/or any other portion of the bra. In other embodiments, all components of the bra are less elastic than are the breast cup connectors. Moreover, the cross straps, breast cups, shoulder straps, and/or other components of the bra can have any suitable elasticities relative to each other. Indeed, in some embodiments, while the breast cup connectors are elastic, the shoulder straps, cross straps, breast cups, and/or other components (e.g., cross cut band 50, connecting band 174 (discussed below, etc.) comprise one or more non-elastic materials. In other embodiments, the shoulder straps comprise one or more elastic materials while the breast cups and cross straps (or support straps) comprise one or more non-elastic materials. In other embodiments, the shoulder straps and breast cups comprise one or more non-elastic materials while the cross straps comprise one or more elastic materials.

In some embodiments, the breast cup connectors (e.g., 19 and 29) are more elastic than the shoulder straps (e.g., 16 and 26), which are more elastic than the breast cups (e.g., 10 and 20), which are more elastic than the cross straps (e.g., 15 and 25). In some other embodiments, the breast cup connectors (e.g., 19 and 29) are more elastic than the shoulder straps (e.g., 16 and 26), which are more elastic than the cross straps (e.g., 15 and 25), which are more elastic than the breast cups (e.g., 10 and 20). In still other embodiments, the breast cup connectors (e.g., 19 and 29) are more elastic than the cross straps (e.g., 15 and 25), which are more elastic than the breast cups (e.g., 10 and 20), which are more elastic than the shoulder straps (e.g., 16 and 26).

In yet other embodiments, two or more elements of the bra 5 (e.g., the shoulder straps, breast cups (e.g., 10 and 20), cross straps (e.g., 15 and 25), cross cut straps (e.g., 50 and/or 170), connecting bands (e.g., 174, as discussed below), and/or any other suitable components of the bra) have the same or a similar elasticity, which is less elastic than are the breast cup connectors. Indeed, in some embodiments, the shoulder straps, breast cups, and cross straps are all non-elastic or have a similar elasticity (e.g., a lower elasticity than the breast cup connectors, e.g., 19 and/or 29). In some other embodiments, the shoulder straps and breast cups have a similar elasticity that is less elastic than are the cross straps, which are less elastic than the breast cup connectors. In some other embodiments, the shoulder straps and cross straps have a similar elasticity that is less elastic than are the breast cups, which are less elastic than are the breast cup connectors. In still some other embodiments, the breast cups and the cross straps have a similar elasticity that is more elastic than are the shoulder straps and less elastic than the breast cup connectors.

In some other embodiments, the cross cut band (e.g., 50 and/or 170, as discussed above and below) and/or a connecting band (e.g., 174, as discussed below) is as elastic, or even more elastic, than the breast cup connectors (e.g., 19 and 29). In some such embodiments, the first and second breast support devices can be connected to such a band while being able to move independently of each other. In some other embodiments, however, the cross cut band and/or the connecting band comprise one or more non-elastic materials. Indeed, the various components of the bra can have any suitable combination of relative elasticities.

In some embodiments, the functional brassiere 5 comprises any suitable material configured to reduce slipping of one or more of the components of the functional brassiere against the user's skin surface. In some embodiments, a non-slip material is placed along at least a portion of the cross straps (or support straps), the connecting band to prevent slipping of the cross strap against the user's torso. For example, the non-slip substance (e.g., a siliconized, rubberized fabric, and/or any other suitable slip-resistant material) may be placed along the interior side of a first and/or second cross strap 15 and/or 25, and in some embodiments, along a portion that will correspond to a user's side. In some cases, the non-slip material may assist in providing the necessary forces on the shoulders and/or breasts by reducing slipping of the corresponding components on the user's body. In other cases, the non-slip material may be affixed at least in part to some components (e.g., shoulder straps, breast cups, breast cup connectors, etc. to prevent slipping of the functional brassiere from the shoulders, breasts, etc.).

Additionally, the functional bra 5 can also comprise any suitable materials configured to improve the visual aesthetic, and/or fashion appearance of the functional brassiere, including, but not limited to, decorations, patterns, styling, lacing, beading, dyeing, coloring, painting, screen printing, stenciling, bedazzling, sequins, pearls, diamonds, jewels, airbrushing, tie dyeing, embroidery, cross-stitching, applique, and/or any other suitable materials. Furthermore, the functional bra can also be configured to reduce the appearance of seam lines, sewing lines, hem lines, and/or other areas where materials join and/or connect thereby improving the appearance of the functional brassiere under the user's outer clothing. In some embodiments, the functional brassiere is configured as one or more of a balconette bra, a minimizer bra, a push-up bra, a molded cup bra, a T-shirt bra, a full coverage bra, a triangle bra, a soft cup bra, a corset bra, a bullet bra, a bralette, a underwire bra, a swim bra, a sports bra, a support bra, a plunge bra, and/or any other suitable type of bra.

In some embodiments, the functional brassiere 5 comprising a first single breast supporting device 6 and a second single breast supporting device 7 comprises one or more connecting components configured to connect the first single breast supporting device and the second single breast supporting device together. In this regard, the first and second breast supporting devices can be connected to each other in any suitable manner, including, without limitation, via one or more buckles, one or more connectors (e.g., buttons, snaps, straps, hook and loop fasteners, hook and eye fasteners, and/or other suitable connectors), one or more seams, via non-stretchable and/or stretchable stitching, by being connected to a common object (e.g., to each other, a strap, a cross cut band, a band, a garment, an article of clothing, a connecting band, a girdle, a waistband, a shaping band, a shaping component, and/or any other suitable connecting component), and/or in any other suitable manner that allows the first and second breast supporting devices to move (at least partially) independently of each other. Indeed, in some embodiments, the cross straps (or support straps) of the two supporting devices are connected to each other via stitching (e.g., an elastic stitching or otherwise). In some other embodiments, the first and second supporting devices are each coupled to a connecting component that allows the first 10 and second 20 breast cups to resiliently move closer to and/or further from a midline of a user's chest.

While the connecting component can be configured in any suitable manner and can comprise any suitable materials that allow the functional bra to function as intended, at least in some embodiments, the function brassiere comprises a connecting band configured to connect the first single breast supporting device and a second single breast supporting device together. In some embodiments, the connecting band comprises one or more elastomeric bands that connect the first cross strap 15, the second cross strap 25, and/or any other suitable component (e.g., the first cup 10, the second cup 20, the first breast cup connector 19, the second breast cup connector 29, the first shoulder strap 16, the second shoulder strap 26, the cross cut band 50, and/or any other suitable component of the first supporting device to the second supporting device. In some embodiments, a connecting band is configured to connect (e.g., via stitching, looping, webbing, snaps, buttons, and/or in any other suitable manner) the first and second cross straps (and/or a first and second cross cut band and/or any other suitable component) along a portion of their circumference. In some embodiments, the connecting band is configured to connect at least part of the first cross strap and at least part of the second cross strap together. In some embodiments, the elastic modulus of the connecting band is configured to be less than that of the cross straps and/or the cross cut bands.

Figure 11B:
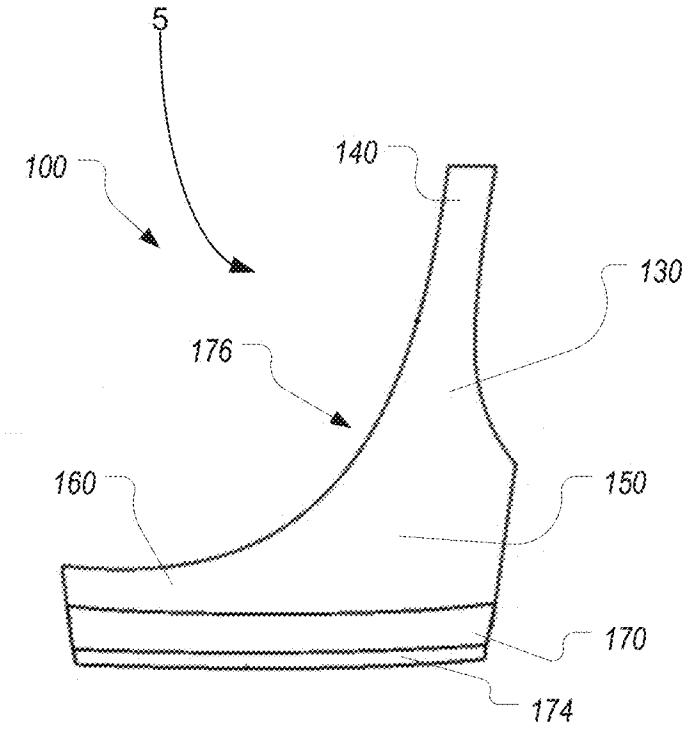
FIGS. 11A-11B respectively provide a front and back view of a representative embodiment of the brassiere.
Figure 11A:
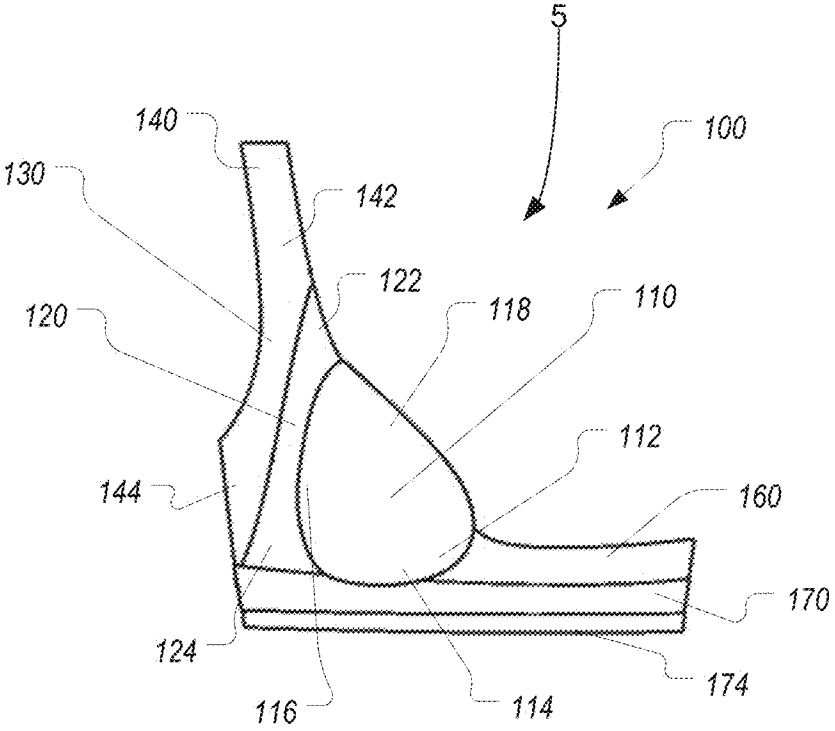

Referring now to FIGS. 11A and 11B, some embodiments of a functional brassiere comprising a first single breast supporting device 100 are shown. While the first single breast supporting device can comprise any suitable component or characteristic that allows it to function as intended (including those described above), FIGS. 11A and 11B show that, at least in some embodiments, the first single breast supporting device 100 comprises a breast cup 110, a first breast cup connector 120 (e.g., comprising an elastomeric and/or any other suitable material), and a first support strap 130. In some embodiments, the breast cup 110 is configured as described above. In other embodiments, the breast cup 110 comprises a first lower inner edge 112 disposed along or in proximity to the medial line of the user's chest, a lower edge 114, a lateral edge 116, and/or a upper inner edge 118. In yet other embodiments, the first breast cup connector 120 can be configured to attach, at least in part, to the lateral edge 116 of the first breast cup 110. The first breast cup connector 120 can further comprise an upper lateral portion 122 and/or a lower lateral portion 124.

While the support strap 130 (or cross strap 160) can comprise any suitable component or characteristic that allows it to extend between the shoulder loop, the breast cup connector, a lateral portion of the breast cup, and/or a medial portion of the breast cup, at least in some embodiments, the support strap 130 (or the cross strap 160) comprises a first shoulder loop 140, a first connecting panel 150, and/or a first cross strap 160. The first shoulder loop 140 can comprise a first portion 142 that is connected at least in part to the upper lateral portion 122 of the first breast cup connector 120. The first shoulder loop can also comprise a second portion 144 that is connected at least in part to the lower lateral portion of the first breast cup connector 120. In some embodiments, the first portion 142 of the shoulder strap 140 and the second portion 144 of the shoulder strap 140 are configured to join together, to comprise a single unitary piece, and/or to otherwise form a first connecting panel 150. In some embodiments, the first connecting panel 150 can be configured to extend at least in part around a portion of a lateral side and/or back of the user. The first connecting panel 150 can be configured to extend into the first cross strap 160. Indeed, in some embodiments, the first connecting panel is simply a portion of the first cross strap 160. That said, in some embodiments, the first cross strap 160 can be configured to extend around a portion of the user's torso. In some cases, the first cross strap 160 is configured to attach to the first breast cup. In other cases, the first cross strap 160 is configured to attach to the first lower inner edge 112 of the breast cup (and/or in any other suitable location).

In some embodiments, the support strap 130 (an/or its corresponding cross strap 160) can be configured as a unitary component, with the first shoulder loop 140, the first connecting panel 150, and/or the first cross strap configured as a single unitary structure to provide support and/or comfort for the user. In other embodiments, the support strap can form any suitable back profile 176. In some cases, the back profile 176 can be configured as a curved half-U profile and/or any other suitable shape to evenly distribute any forces applied by the first single breast supporting device and/or to provide for increased comfort for the user. In other instances the back profile 176 can comprise a rectangular configuration, a V-shaped configuration, and/or an X-shaped configuration as described above.

In some embodiments, the first and/or second single breast supporting device 100 optionally comprises a first cross cut band 170. In some embodiments, the first cross cut band 170 is configured to circumscribe the user's torso below the user's breasts to provide additional support and/or comfort. The first cross cut band 170 can comprise any suitable material, including, without limitation, a non-stretch and/or elastomeric material. Indeed, in some embodiments, the first cross cut band comprises any suitable elastomeric material. The first cross cut band 170 can be configured to attach at least in part to a portion of one or more of the first cross strap 160, the lower edge 114 of the first breast cup 120, the lower lateral portion 124 of the first breast cup connector 120 and/or any other suitable portion of the functional brassiere 5. In some embodiments, the first cross cut band 170 can be configured to attach at a continuous and/or a partial seam to a lower portion of the first cross strap 160, to the lower edge 114 of the first breast cup 120, and/or to the lower lateral portion 124 of the first breast cup connector 120.

In some embodiments, the first single breast supporting device 100 optionally comprises a connecting band 174. In some embodiments, the connecting band 174 can be configured to connect the first single breast supporting device 100 with a second single breast supporting device 200. Although the connecting band 174 can be configured in any suitable manner to connect the first single breast supporting device 100 with the second single breast supporting device 200 (e.g., by comprising a non-stretch and/or an elastomeric material), at least in some embodiments, the connecting band 174 comprises an elastomeric band that attaches at least in part to a lower edge of the cross cut band 170 and/or the cross strap 160. In some embodiments, the connecting band 174 can be configured to connect the first single breast supporting device 100 with the second single breast supporting device 200 without interfering with the function of each individual single breast supporting device. In other words, in some embodiments, the connecting band attaches the first and second breast supporting devices, while allowing each to function substantially independently.

Figure 12D:
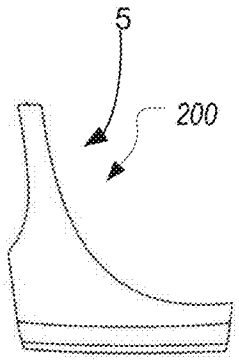
FIGS. 12A-12F provide front and back views of some embodiments of the functional brassiere.
Figure 12C:
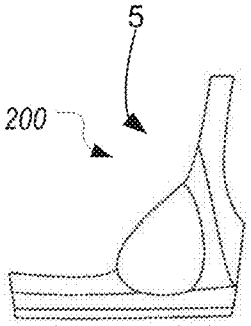
Figure 12B:
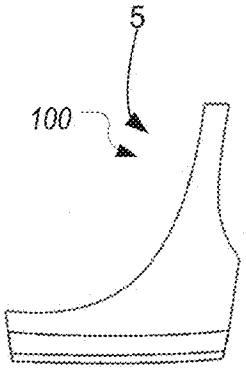
Figure 12A:
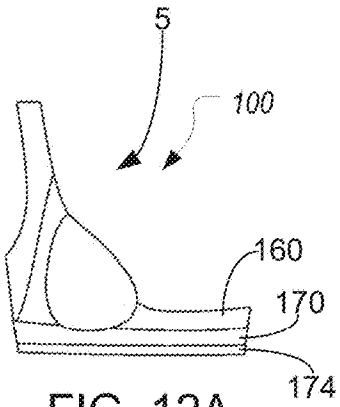
Figure 12F:
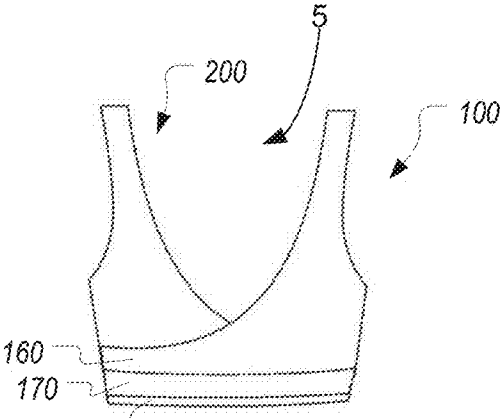
Figure 12E:
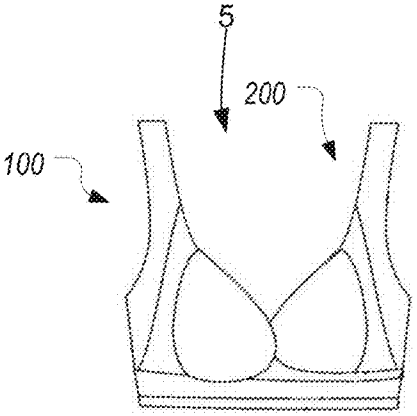

Referring now to FIGS. 12A to 12F, some embodiments of a functional brassiere comprising a first single breast supporting device 100 and a second single breast supporting device 200 are shown (particularly in FIGS. 12E-12F). FIGS. 12A and 12B show front and back views, respectively, of a first single breast supporting device 100. FIGS. 12C and 12D show front and back views, respectively, of a second single breast supporting device 200. In some embodiments, the second single breast supporting device 200 can be configured as essentially a mirror image of the first single breast supporting device 100 comprising the same elements. FIGS. 12E and 12F show front and back views, respectively, of a representative embodiment of a functional brassiere comprising a first single breast supporting device 100 and a second single breast supporting device 200. In some embodiments, portions of the second single breast supporting device 200 may be overlapped by portions of the first single breast supporting device 100. For example, at least a portion of the cross strap 160 and/or the cross cut band 170 may overlap or be overlapped. FIGS. 12E and 12F also show front and back views, respectively, of a representative embodiment of the connecting band 174.

Figure 13A:
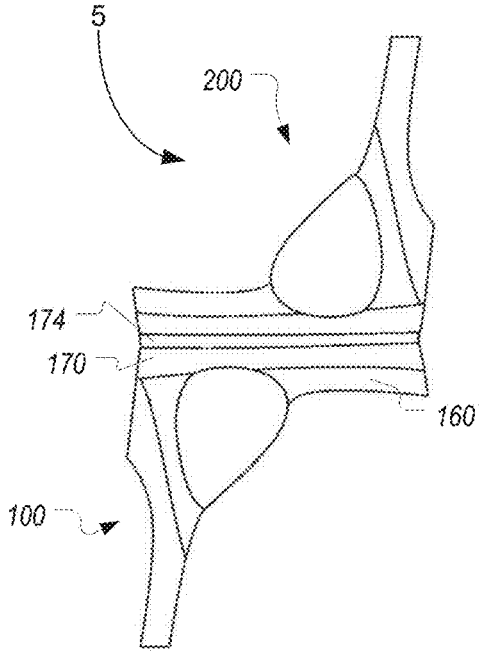
FIGS. 13A-13B provide a front and back view of some embodiments of the functional brassiere with a connecting band.
Figure 13B:
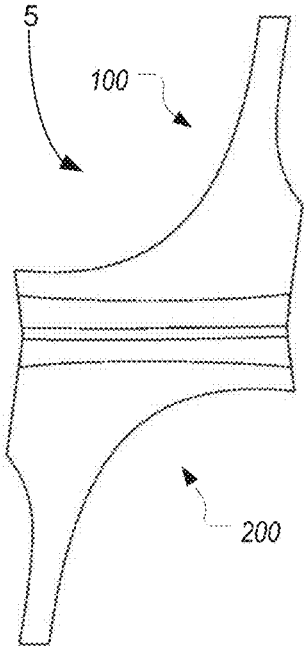
Figure 13C:
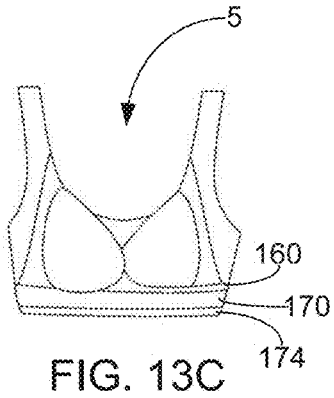
FIGS. 13C-13E provide various views of representative embodiments of the functional brassiere with the connecting band.
Figure 13D:
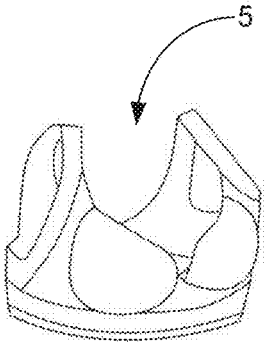
Figure 13E:
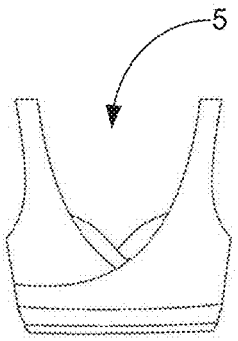

Referring now to FIGS. 13A to 13E, some embodiments of a functional brassiere 5 comprising a first single breast supporting device 100 and a second single breast supporting device 200 are shown. FIGS. 13A and 13B show front and back views, respectively, of a functional brassiere 5 comprising a first single breast supporting device 100 and a second single breast supporting device 200. Although the first and second breast supporting devices can be connected in any suitable manner, including, without limitation, via one or more buttons, snaps, stitches, straps, cords, hook and loop connectors, and/or any other suitable manner, in some embodiments, the cross cut band 170 is configured to be attached to the cross strap 160 at one edge and configured to be attached to the connecting band 174 on another edge. In FIGS. 13A and 13B, embodiments of the first single breast supporting device 100 are shown in a partially inside-out arrangement with an interior surface (e.g., the interior surface of the first breast supporting device configured to contact the user) shown on the outside. FIGS. 13C, 13D, and 13E show, respectively, front, perspective, and back views of some embodiments of a functional brassiere 5 comprising a first single breast supporting device 100 and a second single breast supporting device 200. Additionally, while the first and second supporting devices can be connected by having their cross straps 15 and 25 be connected directly to each other, by having their cross cut bands 170 be connected directly to each other, and/or in any other suitable manner, FIGS. 13A-13E show some embodiments in which the first 100 and second 200 supporting devices are connected via a connecting band 174.

In some embodiments, the cross strap 160 (and/or any other suitable portion of the functional brassiere 5, such as the cross cut band) comprises one or more cross strap fasteners to detachably attach and detach the cross strap 160 along a portion of its length. While the cross strap fastener 162 can comprise any suitable fastener and can be configured to be located at any suitable portion of the cross strap and/or the functional brassiere, at least in some embodiments, the cross strap fastener is configured to be located at a back portion of the cross strap 160, cross cut band, and/or another suitable portion of the bra. For example, FIGS. 14A-14D show some embodiments of the cross strap fastener 162 placed along a portion of the cross strap 160 that is configured to extend along the back of the user. FIGS. 14A and 14B show, respectively, back views of the second single breast supporting device 200 and the first single breast supporting device 100. FIGS. 14C and 14D show back views of the functional brassiere 5 comprising a first single breast supporting device 100 and a second single breast supporting device 200 with the cross strap fastener 162 placed along a back portion of the cross strap 160 and/or another suitable portion of the bra.

As described above, the cross strap fastener 162 can comprise any suitable configuration and/or any suitable materials that allow the functional bra 5 to function as intended. At least in some embodiments, the cross strap fastener 162 is configured to detachably couple a portion of the cross strap 160 and/or another suitable portion of the bra. The cross strap fastener 162 can comprise any suitable fastener for coupling a portion of the cross strap 160 and/or one or more other portions of the bra (e.g., clasps, buttons, fasteners, snaps, zippers, clips, ties, buckles, tacks, hook-and-eye closure, stitches, pins, hook and loop fasteners, and/or any other suitable fastener). In some embodiments, the cross strap fastener 162 can comprise a hook and loop fastener (e.g., VELCRO®).

Figure 15A:
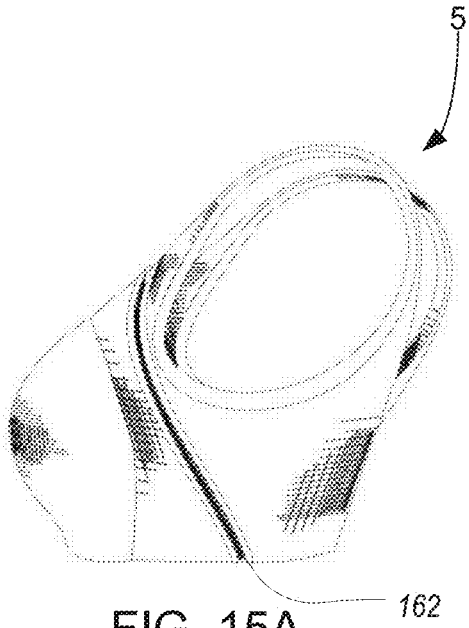
FIGS. 15A-15C provide side views of the functional brassiere with the cross strap connector located on a lateral side in accordance with some embodiments.
Figure 15B:
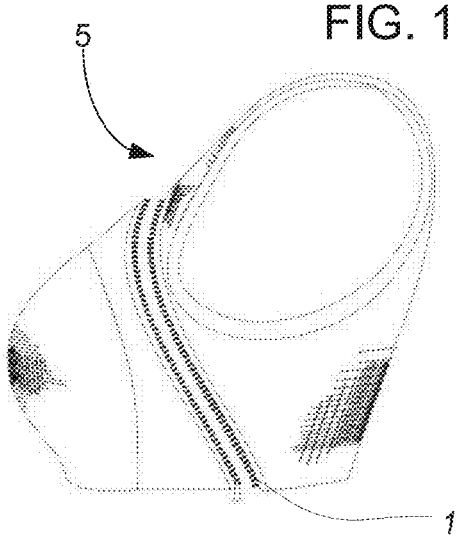
Figure 15C:
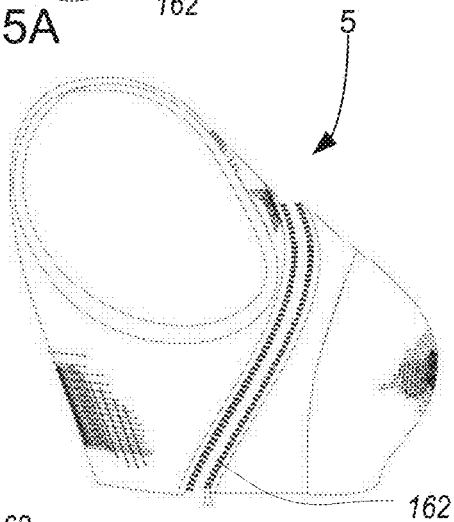
Figure 16B:
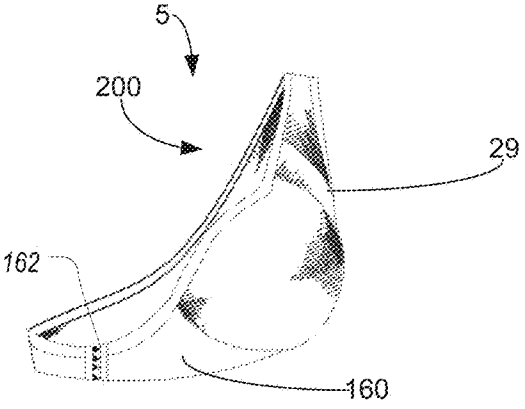
FIGS. 16A-16D provide front and back views of embodiments of the functional brassiere with the cross strap connector located on a front side.
Figure 16A:
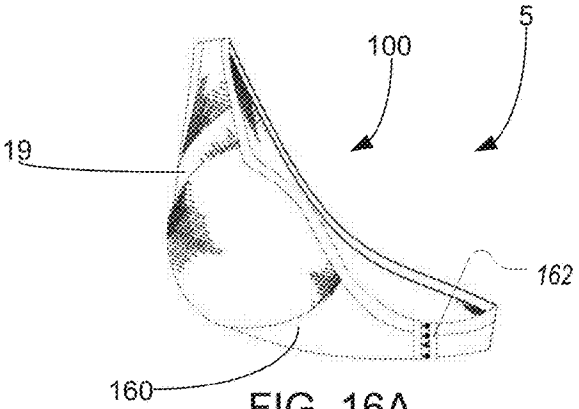
Figure 16D:
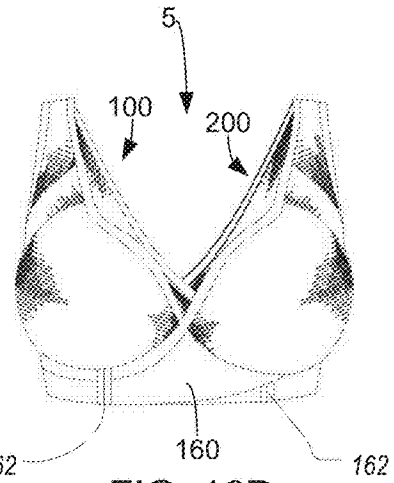
Figure 16C:
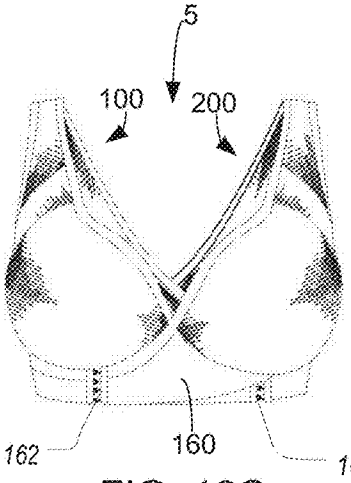

In some embodiments, the cross strap fastener 162 is be configured to be placed on a lateral side of the functional brassiere 5. For example, the cross strap fastener can comprise a zipper and/or other suitable fastener that is placed on a lateral left side of the functional brassiere. In some cases, the first single breast supporting device can comprise a cross strap fastener 162 placed on a left side of the functional brassiere and the second single breast supporting device can comprise a cross strap fastener 162 placed on the right lateral side of the functional brassiere. In other instances, the cross strap fastener of the first and second single breast supporting devices can be placed on a common lateral side. FIGS. 15A and 15B show some embodiments of a cross strap fastener 162 placed on the left side of the functional bra. FIG. 15C shows some embodiments of a cross strap fastener 162 placed on the right side of the functional bra 5.

In some embodiments, the cross strap fastener 162 is configured to be located on a front portion of the cross strap 160 and/or another suitable portion of the bra 5. FIGS. 16A-16D show some embodiments of a cross strap fastener 162 configured to be located on the front and/or a front lateral portion of the cross strap 160. In some instances, the cross strap fastener of the first single breast supporting device 100 can be configured to be located on the front portion of the first cross strap 160 such that the cross strap fastener 162 is located below the breast cup of the second single breast supporting device 200. Likewise, the cross strap fastener of the second single breast supporting device 200 can be configured to be located on the front portion of the cross strap such that the cross strap fastener 162 is located below the breast cup of the first single breast supporting device 100.

Figure 17:
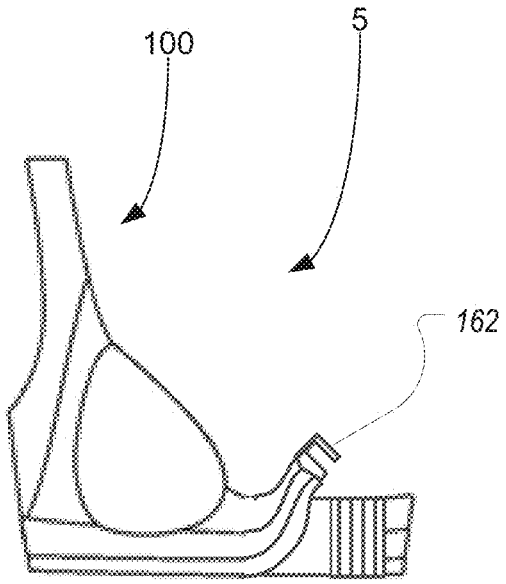
FIG. 17 provides a front view of a representative embodiment of the functional brassiere with an adjustable cross strap connector.

In some embodiments, the cross strap fastener 162 is configured to be adjustable. FIG. 17 shows some embodiments of a cross strap fastener 162 configured to be adjustable. In some embodiments the cross strap fastener 162 is configured such that the user can adjust the length of the cross strap 160. For example, while the cross strap fastener 162 can comprise any suitable adjustable fastener, including, without limitation, one or more buckles, rings, hook and loop fasteners, and/or other suitable fasteners that allow a length of cross strap (or another suitable portion of the bra) to be adjusted, in some embodiments the cross strap fastener 162 can be configured with a hook and a series of receiving eyelets. The user can select the appropriate eyelet that corresponds to the desired length of the cross strap. In some instances the user can shorten the cross strap to provide more support. Likewise, the user can lengthen the cross strap to provide more comfort.

Figure 18A:
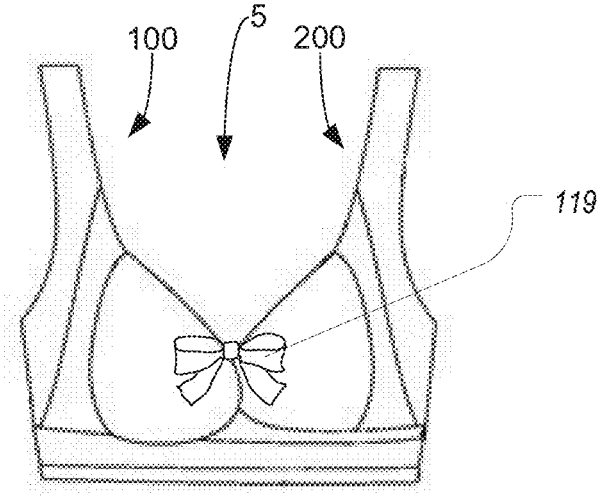
FIGS. 18A-18B provide views of the functional brassiere with breast cup various coupling devices in accordance with some embodiments.
Figure 18B:
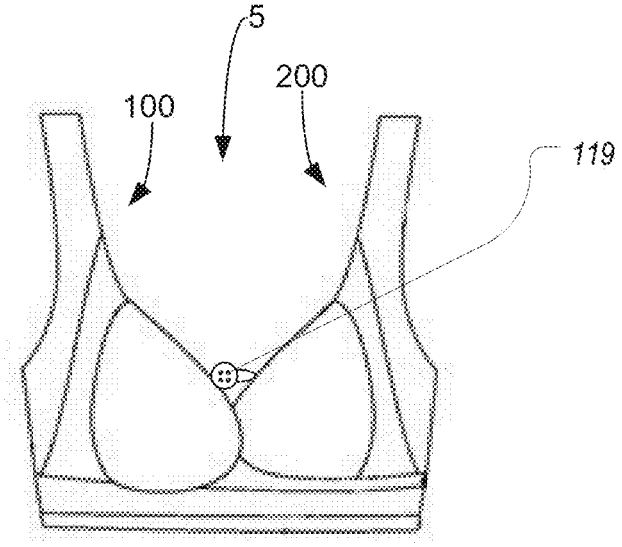

Referring now to FIGS. 18A-18B, some embodiments of a breast cup coupling device 119 are shown. In some embodiments, the breast cup coupling device is configured to selectively couple the first and the second breast cups to provide additional stability and support. While the breast cup coupling device 119 can comprise any suitable configuration and/or any suitable materials that allow the breast cups to be coupled to provide additional stability and support, at least in some embodiments, the breast cup coupling device 119 is configured to detachably couple a portion of each breast cup from the first single breast supporting device 100 and the second breast supporting device 200. In some embodiments, the breast cup coupling device 119 can be configured to couple the upper inner edge 118 of each breast cup together. In other embodiments, the breast cup coupling device 119 can be configured to enhance visual appearance by increasing cleavage. In yet other embodiments, the breast cup coupling device 119 can be configured to provide additional stability and support by further securing the breasts. In some embodiments, the user couples the breast cup coupling device 119 when more stability, more support, and/or enhanced cleavage are desired and uncouples the breast cup coupling device 119 when more comfort is desired.

The breast cup coupling device 119 can comprise any suitable device for coupling the breast cups together including, but not limited to, a ribbon tie, a button and eyelet, a bow, a buckle, a clasp, a butterfly clasp, a tensioner, a fastener, a snap-fit buckle, a hook and loop fastener, a button, a snap, a zipper, a clip, a tie, a strap, a hook-and-eye closure, and/or any other suitable coupler. FIG. 18A illustrates the breast cup coupling device 119 configured as a ribbon tie device. FIG. 18B illustrates the breast cup coupling device 119 configured as a button and eyelet device.

Figure 19:
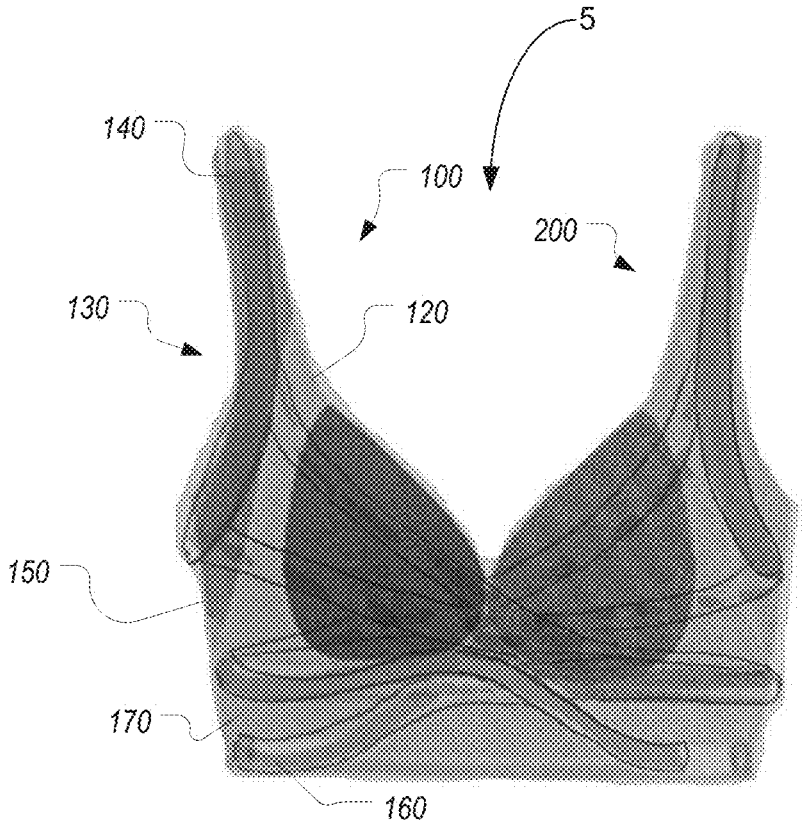
FIG. 19 provides a view of the functional brassiere with shoulder loops that connect to the cross strap in accordance with some embodiments.

Referring now to FIG. 19, some embodiments of a functional brassiere 5 comprising a first single breast supporting device 100 and a second single breast supporting device 200 are shown. In some embodiments, the support strap 130 is configured with the first shoulder loop 140 attaching to the lateral edge of the breast cup connector 120 (or the breast cup itself) to pass over the user's shoulder on one end and along the user's lateral side on another end. In some instances, both ends of the shoulder loop 140 join to form the cross strap 160. In other instances, the cross strap 160 can extend around the user's torso and attach to the cross cut band 170. In some embodiments, one or more ends of the shoulder loop 140 are connected to the connecting panel 150. In other embodiments, one or more ends of the shoulder loop 140 are configured to pass through channels formed in the connecting panel 150 such that the shoulder loop 140 can move with respect to the connecting panel 150 to provide support and visual enhancement. In yet other embodiments, the cross strap band 160 is configured to fixedly and/or adjustably pass through channels in one or more of the connecting panel 150 and/or the cross cut band 170. In some embodiments, at least a portion of the support strap 130 is configured to pass through channels formed in the connecting panel 150 and/or the cross cut band 170 to allow for the single breast supporting device to move with respect to the connecting panel 150 and/or the cross cut band 170 to allow the functional brassiere to distribute and/or apply forces to draw the shoulders back, improve posture, and/or enhance visual appearance of breasts. In other embodiments, at least a portion of the support strap 130 is configured to pass through channels formed in the connecting panel 150 and/or the cross cut band 170 to allow for each individual single breast supporting device to function independently or at least substantially independently.

Figure 20A:
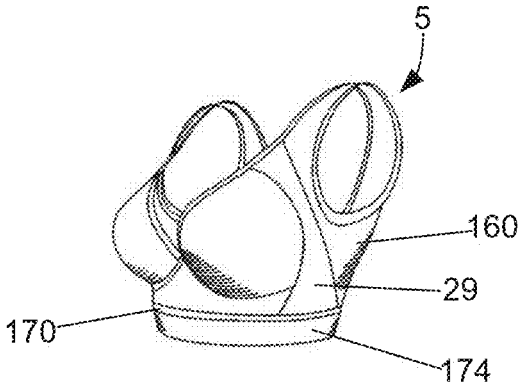
FIGS. 20A-20H provide several views of the functional brassiere in accordance with some embodiments.
Figure 20B:
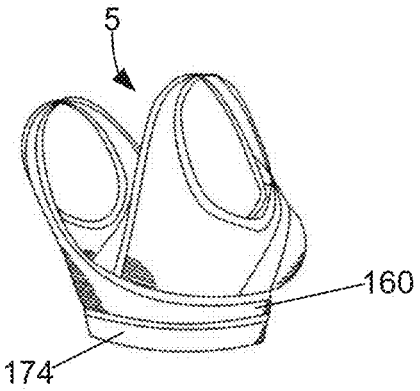
Figure 20C:
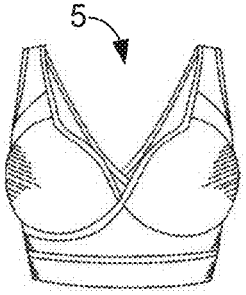
Figure 20D:
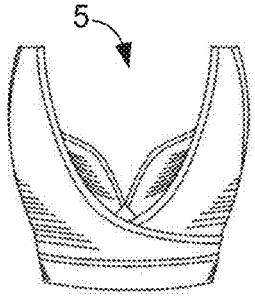
Figure 20E:
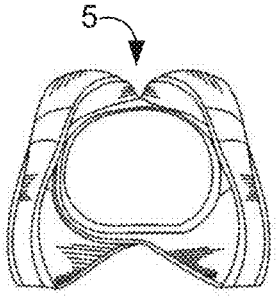
Figure 20F:
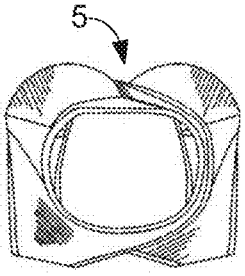
Figure 20G:
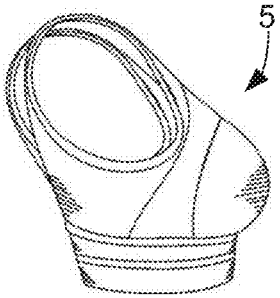
Figure 20H:
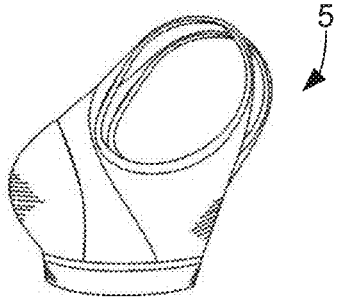

Referring now to FIGS. 20A-20H, some ornamental designs of a functional brassiere 5 comprising a first single breast supporting device and a second single breast supporting device are shown. FIGS. 20A-20B illustrates a front and back perspective view. FIGS. 20C-20D illustrates a front and back view. FIGS. 20E-20F illustrates a top and bottom view. FIGS. 20G-20H illustrates side views.

Figure 21A:
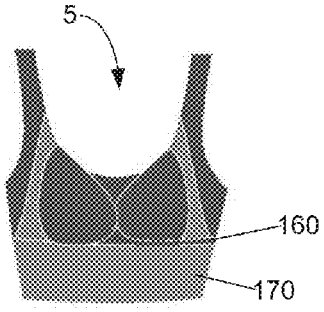
FIGS. 21A-21O provide several views of the functional brassiere in accordance with some embodiments.
Figure 21B:
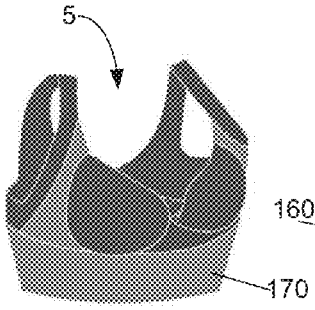
Figure 21C:
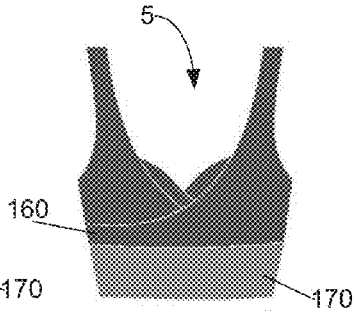
Figure 21D:
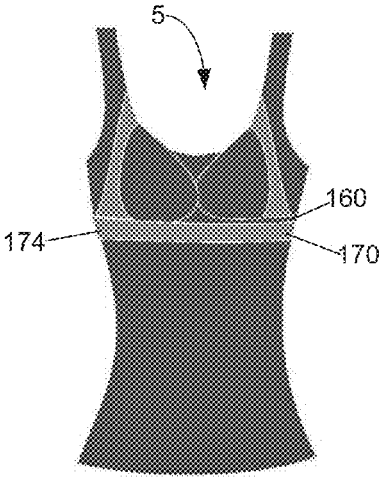
Figure 21E:
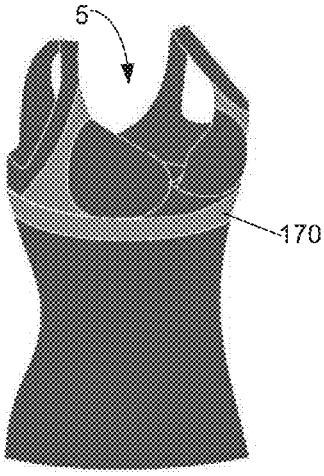
Figure 21F:
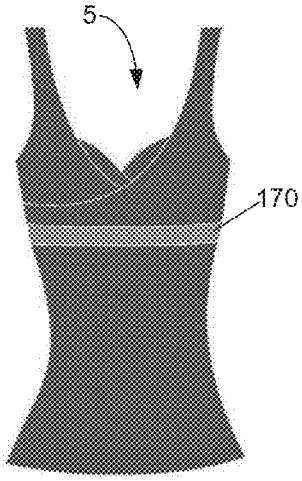
Figure 21G:
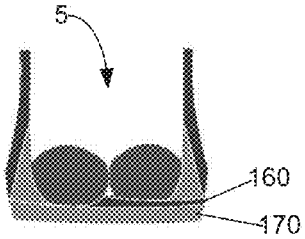
Figure 21H:
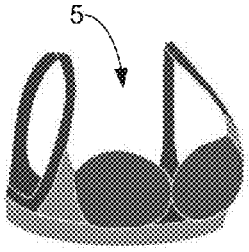
Figure 21I:
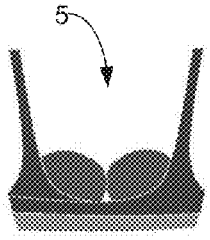
Figure 21J:
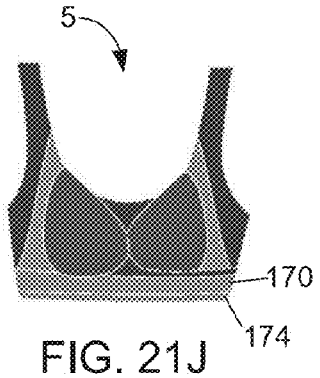
Figure 21K:
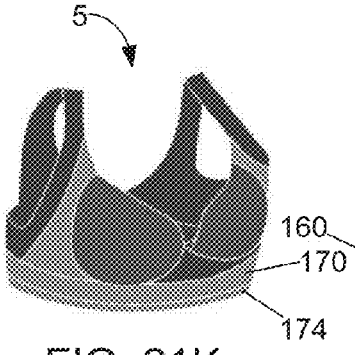
Figure 21L:
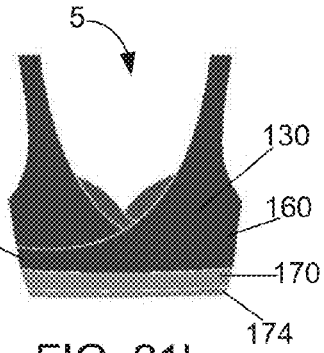
Figure 21M:
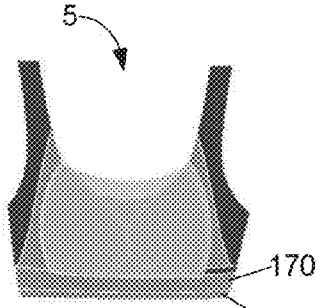
Figure 21N:
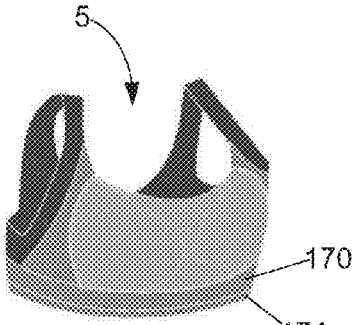
Figure 21O:
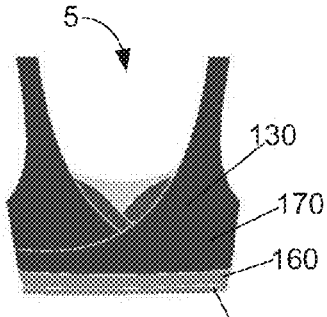
Figure 22A:
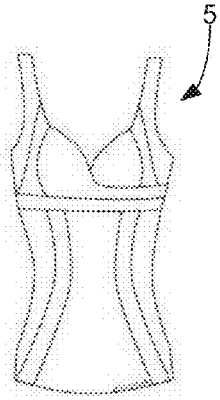
FIGS. 22A-22F provide several views of the functional brassiere incorporated into shapewear in accordance with some embodiments.
Figure 22B:
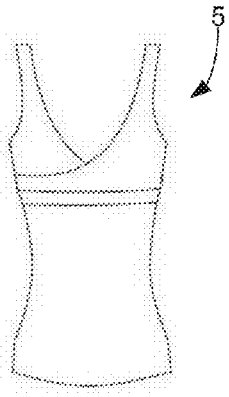
Figure 22C:
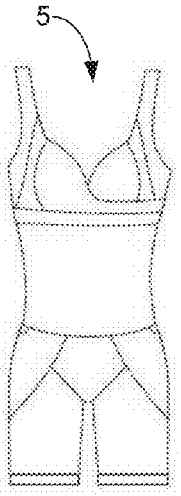
Figure 22D:
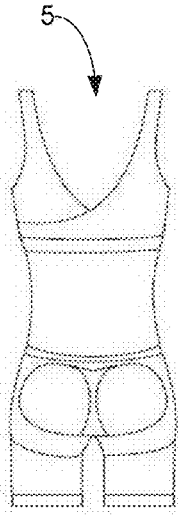
Figure 22E:
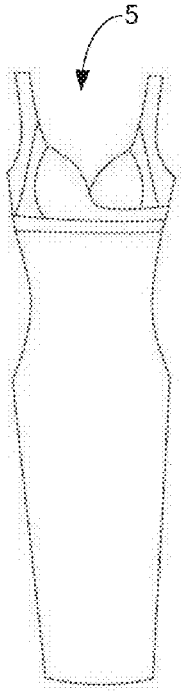
Figure 22F:
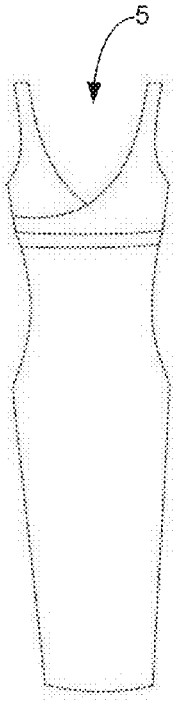

Referring now to FIGS. 21A-21O and FIGS. 22A-22F, some embodiments of a functional brassiere 5 incorporated into other configurations of underclothing and clothing are illustrated. While the functional brassiere can be incorporated into any other suitable configuration of underclothing or clothing that allow it to function as intended, FIGS. 21A-21O and FIGS. 22A-22F show that, at least in some embodiments, the functional brassiere 5 is included where there is a desire to increase the visual appearance of the user's breasts and/or to simultaneously maintain or correct the user's posture. For example, the functional bra can be incorporated into swimsuits, bikinis, bra shirts, shirts, blouses, camisoles, tops, bra dresses, vests, nightgowns, pajamas, lingerie, shapewear, support wear, undergarments, foundation garments, exercise clothing, bicycling clothing, sports clothing, girdles, waistbands, and/or any other suitable clothing or garments. FIGS. 21A-21C illustrate some embodiments of a functional bra 5 incorporated into upper body shapewear (e.g., a girdle, shaping band, waistband, etc.). FIGS. 21D-21F illustrate some embodiments of a functional bra 5 incorporated into an upper body shapewear camisole. FIGS. 21G-21I illustrates some embodiments of a functional bra 5 configured as a balconette style bra. FIGS. 21J-21L illustrate some embodiments of a functional bra 5. FIGS. 21M-21O illustrate some embodiments of a functional bra 5 configured with a front panel. FIGS. 22A-22B illustrate some embodiments of a functional bra 5 incorporated into upper body shapewear. FIGS. 22C-22D illustrate some embodiments of a functional bra 5 incorporated into body shapewear. FIGS. 22E-22F illustrate some embodiments of a functional bra incorporated into a bra dress or a bra and slip combination.

Figure 23A:
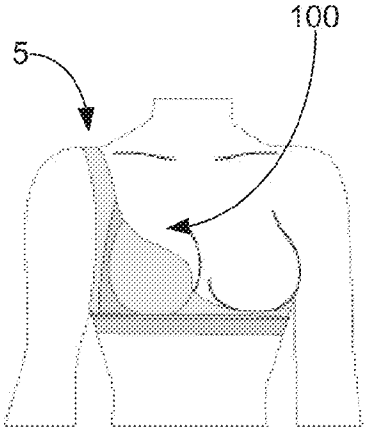
FIGS. 23A-23J provide several views of the functional brassiere as worn by a user in accordance with some embodiments.
Figure 23B:
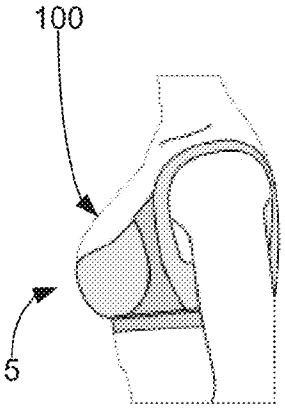
Figure 23C:
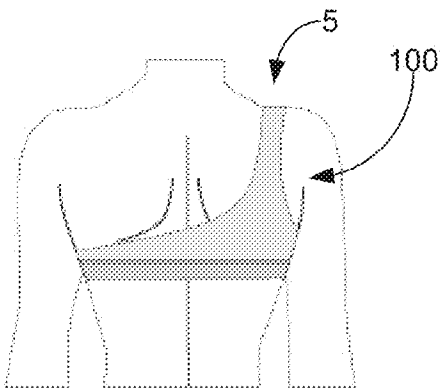
Figure 23D:
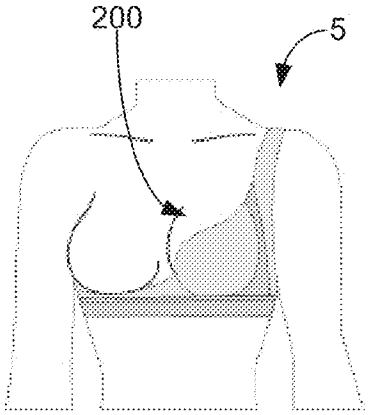
Figure 23E:
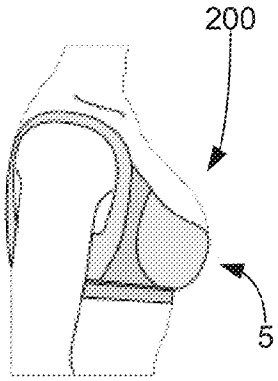
Figure 23F:
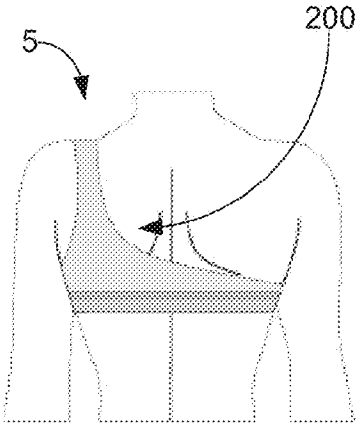
Figures 23G, 23H, 23I, 23J:
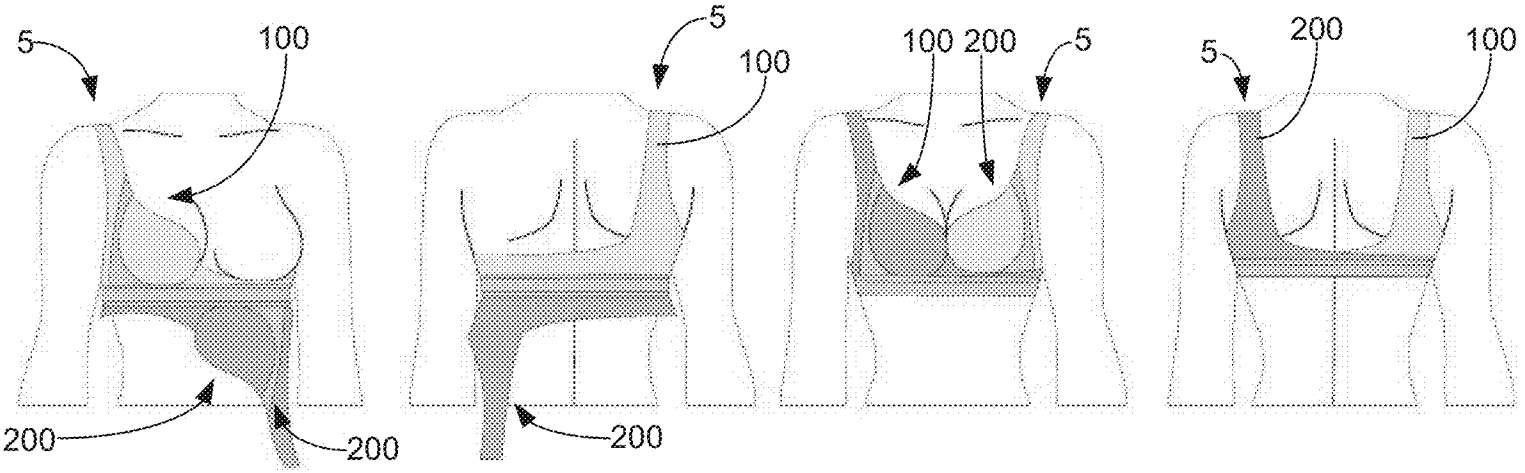

Referring now to FIGS. 23A-23F, some embodiments of a functional brassiere 5 comprising a first single breast supporting device 100 or a second single breast supporting device 200 are shown as worn by the user. FIGS. 23A-23C show views of a first single breast supporting device 100 as worn by the user. As shown, the first single breast supporting device supports a first breast to enhance visual appearance, provide support, and/or improve posture. FIGS. 23D-23F show views of a second single breast supporting device 200 as worn by the user. As shown, the second single breast supporting device supports a second single breast to enhance visual appearance, provide support, and/or improve posture. FIGS. 23G-23H show views of a functional brassiere 5 comprising a first single breast supporting device 100 and a second single breast supporting device 200 as worn by the user. The first single breast supporting device and a second single breast supporting device can be connected in any suitable manner, including, without limitation, by a connecting band. Although a user can put on such a bra in any suitable manner, in some embodiments, the user can fit the first single breast supporting device onto her body and then can fit the second single breast supporting device on to her body as shown in FIGS. 23G-23J.

While the functional brassiere can be used in any suitable manner, in accordance with some embodiments, the bra is used in a method for supporting breasts and for providing visual enhancement of breasts, where the method comprises: providing a first single breast supporting device comprising: a first breast cup configured to support a first single breast of a user, the first breast cup comprising an inner edge configured to be disposed near a medial portion of the user's chest when the user wears the functional garment; a first breast cup connector comprising a first piece of elastomeric material extending along a lateral side of the first breast cup; and a first support strap comprising a first shoulder loop, a first connecting panel, and a first cross strap; wherein a first portion of the first shoulder loop is connected at least in part to an upper lateral portion of the first breast cup connector and is configured to extend over the user's first shoulder, wherein a second portion of the first shoulder loop is connected at least in part to a lower lateral portion of the first breast cup connector and is configured to extend at least in part around a portion of the user's torso, wherein the first portion and the second portion are configured to join together to form the first connecting panel, the first connecting panel extending into a first cross strap that is configured to extend around a portion of user's torso and attach to the inner edge of the first breast cup; wearing the first single breast supporting device such that the first breast cup supports the first single breast such that the first cross strap extends around a portion of the user's torso and such that the first shoulder loop extends over a first shoulder of the user and places a first force on the user's first shoulder in such a way as to perform at least one of bringing the first shoulder back and bringing a shoulder blade of the first shoulder closer to a medial line of the user's back; and wearing the first single breast supporting device such that the first cross strap extends around the portion of the user's torso, the first shoulder loop extends over the user's first shoulder, and the first breast cup supports the first single breast and places a second force on the first single breast in such a way as to perform at least one of bringing the first single breast closer to a medial line of the user's chest and lifting the first single breast.

In some cases, the method further comprises: providing a second single breast supporting device comprising: a second breast cup configured to support a second single breast of a user, the second breast cup comprising an inner edge configured to be disposed near a medial portion of the user's chest when the user wears the functional garment; a second breast cup connector comprising a second piece of elastomeric material extending along a lateral side of the second breast cup; and a second support strap comprising a second shoulder loop, a second connecting panel, and a second cross strap; wherein a first portion of the second shoulder loop is connected at least in part to an upper lateral portion of the second breast cup connector and is configured to extend over the user's second shoulder, wherein a second portion of the second shoulder loop is connected at least in part to a lower lateral portion of the second breast cup connector and is configured to extend at least in part around a portion of the user's torso, wherein the first portion and the second portion are configured to join together to form the second connecting panel, the second connecting panel extending into a second cross strap that is configured to extend around a portion of user's torso and attach to the inner edge of the second breast cup; wearing the second single breast supporting device such that the second breast cup supports the second single breast such that the second cross strap extends around a portion of the user's torso and such that the second shoulder loop extends over a second shoulder of the user and places a first force on the user's second shoulder in such a way as to perform at least one of bringing the second shoulder back and bringing a shoulder blade of the second shoulder closer to a medial line of the user's back; and wearing the second single breast supporting device such that the second cross strap extends around the portion of the user's torso, the second shoulder loop extends over the user's second shoulder, and the second breast cup supports the second single breast and places a second force on the second single breast in such a way as to perform at least one of bringing the second single breast closer to a medial line of the user's chest and lifting the second single breast.

Additionally, in some cases, the method further comprises: adjusting one or more of the first breast cup, the second breast cup, the first breast cup connector, the second breast cup connector, the first support strap, the second support strap, the first shoulder loop, the second shoulder loop, the first connecting panel, the second connecting panel, the first cross strap, and the second cross strap to provide support that visually enhances the user's breasts by at least one of bringing the user's breasts closer together and lifting the user's breasts and further performs at least one of drawing the user's shoulders back and bringing the user's shoulder blades closer together.

In some embodiments, the described device also comprises a functional garment comprising: a first single breast supporting device comprising: a first breast cup configured to support a first single breast of a user, the first breast cup comprising an inner edge configured to be disposed near a medial portion of the user's chest when the user wears the functional garment; a first breast cup connector comprising a first piece of elastomeric material extending along a lateral side of the first breast cup; and a first support strap comprising a first shoulder loop, a first connecting panel, and a first cross strap; wherein a first portion of the first shoulder loop is connected at least in part to an upper lateral portion of the first breast cup connector and is configured to extend over the user's first shoulder, wherein a second portion of the first shoulder loop is connected at least in part to a lower lateral portion of the first breast cup connector and is configured to extend at least in part around a portion of the user's torso, wherein the first portion and the second portion are configured to join together to form the first connecting panel, the first connecting panel extending into a first cross strap that is configured to extend around a portion of user's torso and attach to the inner edge of the first breast cup.

In still other embodiments, the described device further comprises: a second single breast supporting device comprising: a second breast cup configured to support a second single breast of the user, the second breast cup comprising an inner edge configured to be disposed near a medial portion of the user's chest when the user wears the functional garment; a second breast cup connector comprising a second piece of elastomeric material extending along a lateral side of the second breast cup; and a second support strap comprising a second shoulder loop, a second connecting panel, and a second cross strap; wherein a first portion of the second shoulder loop is connected at least in part to an upper lateral portion of the second breast cup connector and is configured to extend over the user's second shoulder, wherein a second portion of the second shoulder loop is connected at least in part to a lower lateral portion of the second breast cup connector and is configured to extend at least in part around a portion of the user's torso, wherein the first portion and the second portion are configured to join together to form the second connecting panel, the first connecting panel extending into a second cross strap that is configured to extend around a portion of user's torso and attach to the inner edge of the second breast cup.

In some embodiments, the first connecting panel is configured to attach to the first cross cut band and wherein the second connecting panel is configured to attach to the second cross cut band.

Additionally, in some embodiments, a bottom portion of the first breast cup is configured to attach to the first cross cut band and wherein a bottom portion of the second breast cup is configured to attach to the second cross cut band.

All the documents cited herein are incorporated into the invention as reference, as if each of them is individually incorporated. Further, it would be appreciated that, in the above teaching of the invention, the skilled artisan could make certain changes or modifications to the invention, and these equivalents would still be within the scope of the invention defined by the appended claims of the present application.

The terms "a," "an," "the" and similar referents used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

It is contemplated that numerical values, as well as other values that are recited herein are modified by the term "about", whether expressly stated or inherently derived by the discussion of the present disclosure. As used herein, the term "about" defines the numerical boundaries of the modified values so as to include, but not be limited to, tolerances and values up to, and including the numerical value so modified. That is, numerical values can include the actual value that is expressly stated, as well as other values that are, or can be, the decimal, fractional, or other multiple of the actual value indicated, and/or described in the disclosure.

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments of this invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

While several methods are disclosed herein, such methods are only to be limited as required by the claims. Accordingly, the various portions of the described methods can be reordered, omitted, augmented, substituted, and/or otherwise modified in any suitable manner. In closing, it is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

What is claimed is:

1. A first single breast supporting device comprising:
a first breast cup;
a first shoulder strap;
a first breast cup connector comprising a first piece of material extending along and coupled to an entire lateral side of the first breast cup, the first breast cup connector connecting, and being at least partially disposed between, the first breast cup and the first shoulder strap; and
a first cross strap that is configured to extend around a first portion of a user's torso, the first cross strap being configured to attach to an inner medial portion of the first breast cup and a second portion which attaches to the first breast cup connector,
wherein the first breast cup connector comprises an elastomeric material.

2. The device of claim 1, further comprising:
a second single breast supporting device comprising:
a second breast cup;
a second shoulder strap; and
a second cross strap that is configured to extend around a second portion of the user's torso, the second shoulder strap being configured to attach to an inner medial edge of the second breast cup and to a second breast cup connector comprising a second piece of material extending along and coupled to an entire lateral side of the second breast cup, the second breast cup connector connecting, and being at least partially disposed between the second breast cup and the second shoulder strap.

3. The device of claim 2, further comprising an elastomeric connecting band that couples the first and the second single breast supporting devices together.

4. The device of claim 2, further comprising a coupling device configured to selectively couple the first and the second cross straps.

5. The device of claim 1, wherein the first shoulder strap is configured to connect to the first cross strap along a user's chest, to extend over a shoulder of the user, and to connect to the first cross strap along a portion of a back of the user.

6. The device of claim 1, wherein the first shoulder strap comprises a first shoulder loop, and wherein a portion of the first shoulder strap loop runs along a portion of the lateral side of the first breast cup, and wherein the first shoulder loop is coupled to the first cross strap.

7. A functional garment comprising:
a first single breast supporting device comprising:
a first breast cup;
a first shoulder strap;
a first breast cup connector comprising a first piece of elastomeric material extending along and coupled to an entire lateral side of the first breast cup; and
a first cross strap that is configured to extend around a portion of a user's torso, the first cross strap having a first end portion that attaches to a medial edge of the first breast cup and a second portion which attaches to the first breast cup connector, wherein the first breast cup is configured to support a first breast of the user; and
a second single breast supporting device comprising:
a second breast cup;
a second shoulder strap;
a second breast cup connector comprising a second piece of elastomeric material extending along and coupled to an entire lateral side of the second breast cup; and
a second cross strap that is configured to extend around a portion of user's torso, the second cross strap having a first end portion that attaches to a medial edge of the second breast cup and a second portion which attaches to the second breast cup connector, wherein the second breast cup is configured to support a second breast of the user.

8. The functional garment of claim 7, wherein the first and second single breast supporting devices are coupled to each other via a connecting band.

9. The functional garment of claim 7, further comprising an elastomeric connecting band that connects the first and the second single breast supporting devices.

10. The functional garment of claim 7, wherein a bottom portion of the first breast cup connector is attached to a first cross cut band and wherein a bottom portion of the second breast cup connector is attached to a second cross cut band.

11. The functional garment of claim 7, further comprising a breast cup coupling device configured to selectively couple the first and the second breast cups together to provide additional stability and support.

12. The functional garment of claim 7, wherein the first shoulder strap comprises a first shoulder loop, and wherein a portion of the first shoulder strap loop runs along a portion of the lateral side of the first breast cup, and wherein the first shoulder loop is coupled to the first cross strap.

13. The functional garment of claim 7, wherein the first breast cup, the first support strap, and the first breast cup connector are coupled together such that when the functional garment is worn by the user, the garment is configured to provide support that visually enhances the user's breasts by at least one of bringing the user's breasts closer together and lifting the user's breasts.

14. A functional garment comprising:

a first single breast supporting device comprising:

a first breast cup;

a first shoulder strap; and a first cross strap, wherein the first shoulder strap comprises a first shoulder strap loop, wherein a portion of the shoulder strap loop runs along a lateral side of the first breast cup, wherein the first cross strap is configured to extend around a first portion of a user's torso, wherein the first shoulder strap loop is coupled to the first cross strap, wherein the first cross strap further comprises a first end portion that attaches to an inner edge of the first breast cup, wherein the inner edge of the first breast cup is configured to be disposed near a medial portion of the user's chest when the user wears the functional garment, and wherein the first breast cup is configured to support a first breast of the user; and a second single breast supporting device comprising:

a second breast cup;

a second shoulder strap; and a second cross strap, wherein the second shoulder strap comprises a second shoulder strap loop, wherein a portion of the shoulder strap loop runs along a lateral side of the second breast cup, wherein the second cross strap is configured to extend around a second portion of user's torso, wherein the second shoulder strap loop is coupled to the second cross strap, wherein the second cross strap further comprises a first end portion that attaches to an inner edge of the second breast cup, wherein the inner edge of the second breast cup is configured to be disposed near the medial portion of the user's chest when the user wears the functional garment, wherein the second breast cup is configured to support a second breast of the user, and wherein the first and second single breast supporting devices are coupled to a common connecting band.

15. The garment of claim 14, further comprising:

a first breast cup connector that comprises an elastomeric material that is disposed between the portion of the first shoulder loop and the lateral side of the first breast cup.

16. A breast supporting device comprising:

a first single breast supporting device comprising:

a first breast cup;

a first shoulder strap;

a first breast cup connector comprising a first piece of material extending along a portion of a lateral side of the first breast cup, the first breast cup connector connecting, and being at least partially disposed between, the first breast cup and the first shoulder strap;

a first cross strap that is configured to extend around a first portion of a user's torso, the first cross strap being configured to attach to an inner medial portion of the first breast cup and a second portion which attaches to the first breast cup connector;

a second single breast supporting device comprising:

a second breast cup;

a second shoulder strap; and a second cross strap that is configured to extend around a second portion of the user's torso, the second shoulder strap being configured to attach to an inner medial edge of the second breast cup and to a second breast cup connector comprising a second piece of material extending along a lateral side of the second breast cup, the second breast cup connector connecting, and being at least partially disposed between the second breast cup and the second shoulder strap; and an elastomeric connecting band that couples the first and the second single breast supporting devices together.

17. A first single breast supporting device comprising:

a first breast cup;

a first shoulder strap;

a first breast cup connector comprising a first piece of elastomeric material extending along a portion of a lateral side of the first breast cup, the first breast cup connector connecting, and being at least partially disposed between, the first breast cup and the first shoulder strap; and a first cross strap that is configured to extend around a first portion of a user's torso, the first cross strap being configured to attach to an inner medial portion of the first breast cup and a second portion which attaches to the first breast cup connector, wherein the first shoulder strap comprises a first shoulder loop, and wherein a portion of the first shoulder strap loop runs along the lateral side of the first breast cup, and wherein the first shoulder loop is coupled to the first cross strap.

18. The device of claim 16, wherein the first breast cup connector comprises an elastomeric material.

19. The device of claim 16, wherein the breast supporting device comprises upper body shapewear that is configured to cover a stomach portion of the user.

20. The device of claim 17, further comprising:

a second breast cup;

a second shoulder strap;

a second breast cup connector comprising a second piece of elastomeric material extending along a portion of a lateral side of the second breast cup, the second breast cup connector connecting, and being at least partially disposed between, the second breast cup and the second shoulder strap; and a second cross strap that is configured to extend around a second portion of the user's torso, the second cross strap being configured to attach to an inner medial portion of the second breast cup and a second portion which attaches to the second breast cup connector, wherein the second shoulder strap comprises a second shoulder loop, wherein a portion of the second shoulder strap loop runs along the lateral side of the second breast cup, and wherein the second shoulder loop is coupled to the second cross strap.

* * * * *